US009388541B2

(12) United States Patent
Kunkel

(10) Patent No.: US 9,388,541 B2
(45) Date of Patent: Jul. 12, 2016

(54) AREA DELINEATOR

(71) Applicant: Chad Kunkel, Jacksonville, FL (US)

(72) Inventor: Chad Kunkel, Jacksonville, FL (US)

( * ) Notice: Subject to any disclaimer, the term of this patent is extended or adjusted under 35 U.S.C. 154(b) by 0 days.

(21) Appl. No.: 14/739,306

(22) Filed: Jun. 15, 2015

(65) Prior Publication Data

US 2015/0315754 A1 Nov. 5, 2015

Related U.S. Application Data

(63) Continuation-in-part of application No. 13/413,730, filed on Mar. 7, 2012, now Pat. No. 9,057,164.

(51) Int. Cl.
*E01F 13/02* (2006.01)

(52) U.S. Cl.
CPC ..... *E01F 13/028* (2013.01); *E01F 13/022* (2013.01)

(58) Field of Classification Search
CPC ..... E01F 13/028; E01F 13/04; E01F 13/022
See application file for complete search history.

(56) References Cited

U.S. PATENT DOCUMENTS 4,317,617 A * 3/1982 Charlton ..... E01F 9/0122 116/63 P
6,969,050 B1 * 11/2005 Loebner ..... E01F 13/028 256/1
6,971,329 B1 * 12/2005 Stewart ..... E01F 9/0122 116/63 C
7,185,690 B2 * 3/2007 Johansson ..... G09F 11/30 160/24
7,538,688 B1 * 5/2009 Stewart ..... E01F 13/028 116/63 C
8,647,587 B2 * 2/2014 Dunn ..... B65F 1/062 220/522
2002/0063248 A1 * 5/2002 Siegler ..... E01F 13/028 256/37
2002/0073912 A1 * 6/2002 Kuo ..... E01F 9/0122 116/63 P
2003/0033742 A1 * 2/2003 Perelli ..... G09F 19/22 40/611.05
2005/0220537 A1 * 10/2005 Bentley ..... B65H 75/38 404/9
2006/0000739 A1 * 1/2006 Kadish ..... B65D 83/0888 206/494
2007/0182567 A1 * 8/2007 Stewart ..... A63B 71/0605 340/572.8
2009/0226252 A1 * 9/2009 Field ..... E01F 13/028 404/6

* cited by examiner

*Primary Examiner* — Abigail A Risic
(74) *Attorney, Agent, or Firm* — Adrienne C. Love

(57) ABSTRACT

A method of using an area delineating device is disclosed for creating a temporary border or barrier between two or more points. The delineating, device has a base including a material housing unit, a hollow upright member, and an exit opening in the upright member. A series of flaps, preferably rubber, are located on the bottom of the base and facilitate access to the material housing unit in which is housed a red of disposable partitioning material, such as caution tape or police tape. The disposable partitioning material threads up from the material housing unit, through the base channel and into the vertical cavity. The disposable partition material then exits the vertical cavity via the exit opening at the top of the delineating device. A series of lineal windows can be present in the vertical member.

20 Claims, 30 Drawing Sheets

AREA DELINEATOR

BACKGROUND OF THE INVENTION

1. Field of the Invention

This invention relates to the field of devices made to establish a temporary physical border or barrier between two or more points or locations. More specifically, this invention comprises a method of using a delineating device capable of housing and dispensing reeled tape.

2. Description of Related Art

Temporary physical borders or barriers are employed in a number of situations. They can be employed to mark of a hazardous area or crime scene, divert the flow of vehicular or pedestrian, traffic, or simply to create multiple spaces out of one larger space. Such temporary borders are typically used by construction crews, military and law enforcement, utility and sanitation crews, and even civilians.

Previously, there were several ways in which such temporary borders or barriers could be created. First, a series of stand-alone markers could be used, such as traffic cones or pylons. However, as the cones are not physically connected, the border or barrier that they create is only imaginary, and the markers could be easily knocked down or blown over. Second, poles or markers connected to partition rope or material that can be independently attached to the poles could be used however, with that method, the permanent partition material must be stored and transported separately. Third, poles or markers containing extendable and retractable partition material within the top portion of the pole or marker could be used; however, when the partition material becomes damaged or soiled, the entire pole or markers must be replaced. Additionally, these poles or markers are often unstable. Fourth, disposable partition material, such as "caution tape," could be used. Such tape typically comes on a reel or spool and can create a temporary border by tying each end of the tape to an object near each point. This can be cumbersome to transport and is not easily and efficiently dispensed. Instead the disposable tape is threaded through several cones or poles and the remainder of the partition material roll must be stored or set on the ground where it could be damaged. Finally, cones that dispense disposable tape from the top of the cone can be used. However, as such cones house the tape at the top, they are unstable and can easily be knocked down or blown over. Further, they are inefficient to use, store and transport.

Therefore, what is needed is a temporary border or barrier system and method that can be easily stored and transported, that uses disposable partition material that can be easily replaced, and that is stable enough withstand weather conditions or being bumped into by vehicular or pedestrian traffic. The present invention achieves this objective, as well as others that are explained in the following description.

BRIEF SUMMARY OF THE INVENTION

The present invention comprises a method of using a temporary area delineating device for creating a temporary border or barrier between two or more points. The delineating device generally comprises a base, a material housing unit, a hollow vertical member, and an exit opening in the vertical member. The base is preferably made of a heavy material, such as rubber. Flaps, preferably rubber, are located on the bottom of the base or the side of material housing unit and facilitate access to the base cavity in which is housed a reel of disposable partitioning material, such as caution tape or police tape. The disposable partitioning material threads up from the material housing unit, through the base channel and into the vertical cavity. The disposable partition material then exits the vertical cavity via the exit opening at the top of the delineating device.

When the reel of partition material in the material housing unit is exhausted, a user can pull out the empty reel through the flaps in the base and replace it with a full reel in a similar fashion. The flaps then secure the full partitioning material reel inside the base cavity. The partitioning material being housed in the base of the delineating device adds to the stability of the invention, enabling it to remain in place even when hit by traffic or when under environmental stress. Then, when the need for the temporary area delineation abates, the dispensed partition material can be cut from the delineating device and discarded.

REFERENCE NUMERALS IN THE DRAWINGS

Figure 1:
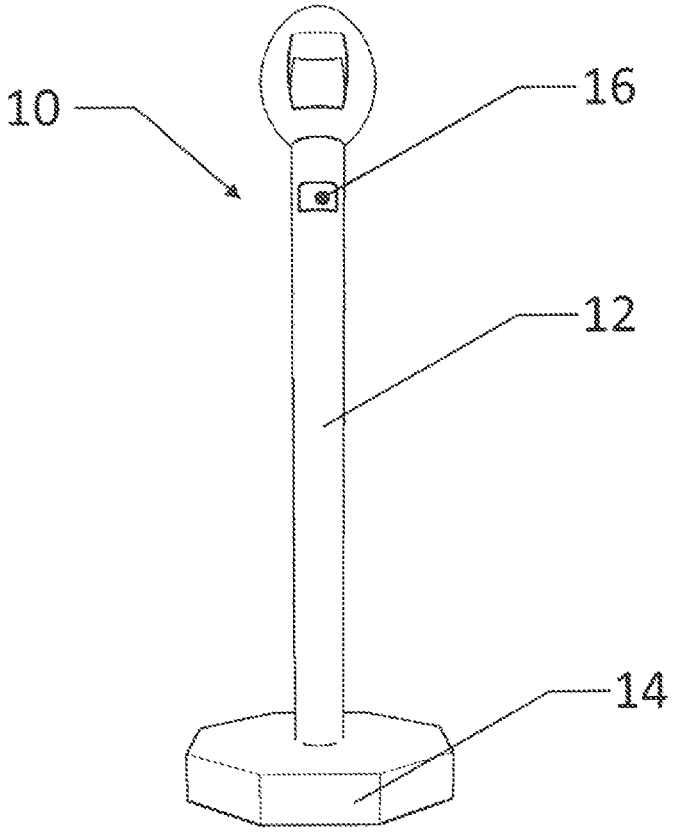
FIG. 1 is a perspective view, showing the exterior of the present invention.

10 delineating device
12 upright member
14 base
16 exit opening
18 upright cavity
20 base cavity
22 flaps
24 base channel
26 partition material
28 partition material reel
30 lineal window
32 top opening
34 brake
36 bottom portion
38 material housing unit
40 material housing cavity
42 side opening
44 spindle
46 base opening
48 light
50 switch
52 brackets
54 battery
56 wiring
58 members
60 stops
62 coupling
64 stabilizing members
66 pivot point
68 barrel
70 tabs
72 voids
74 direct feed port
76 feed assist bar
78 exposed channel
80 groove

DETAILED DESCRIPTION OF THE INVENTION

Figure 2:
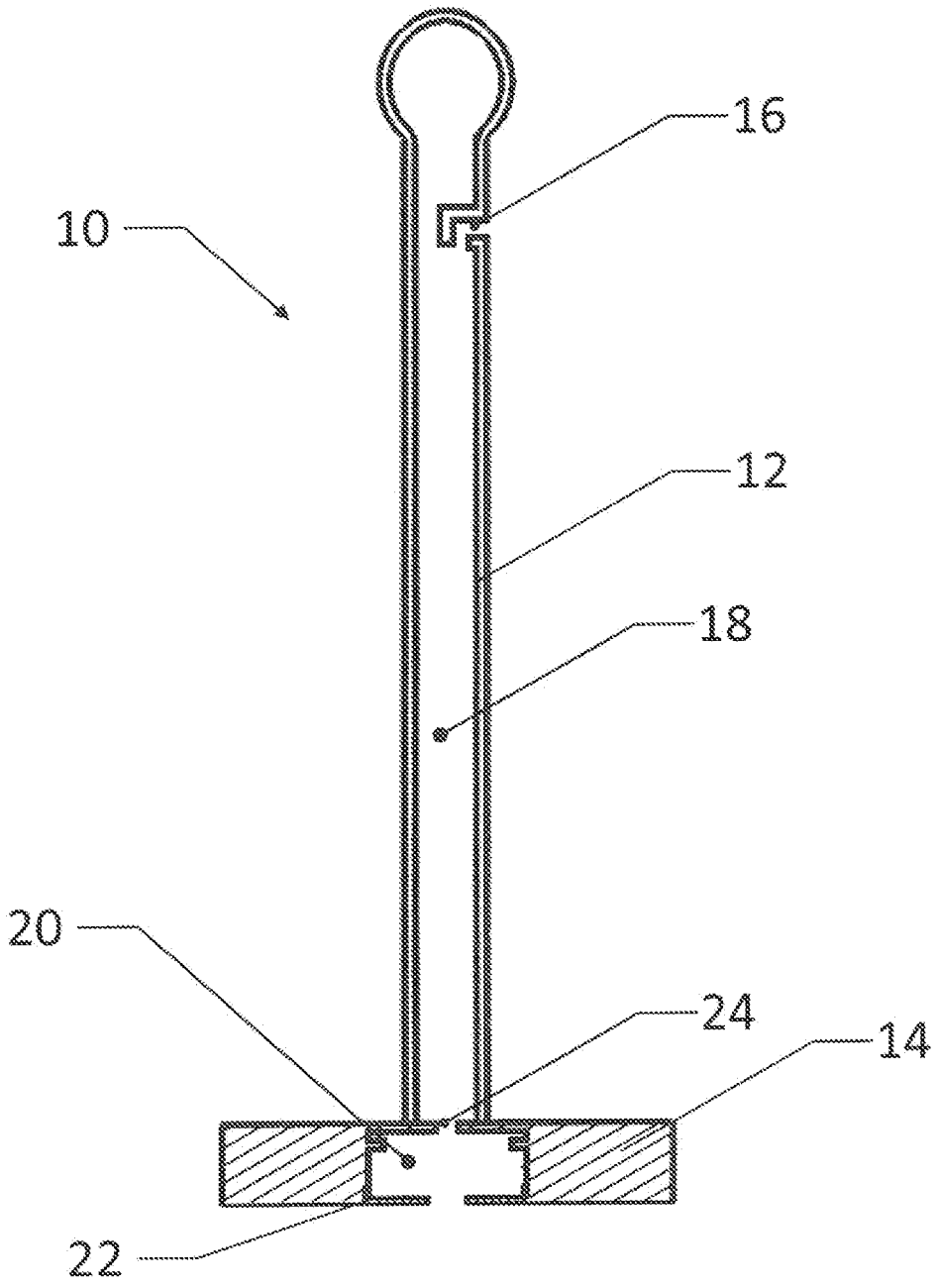
FIG. 2 is a cross-section view, showing the preferred embodiment of the interior of the present invention.

FIG. 1 illustrates the exterior of the delineating device provided by the present method. The delineating device comprises upright member 12 attached to base 14. Upright member 12 further comprises exit opening 16 and upright cavity 18, as shown in FIG. 2. In this embodiment, upright member 12 is made of a hollow rigid material such as plastic or metal, and is in the shape of a pole, cone, or rod. Base 14, in this embodiment, is made of a heavy weight material, such as rubber, which is capable of creating traction when placed on a road or floor and is capable of withstanding impact from vehicles and pedestrians as well as environmental stress. Base 14 is preferably in the shape of a polygon and holds upright member 12 upright. As shown in FIG. 2, base 14 comprises base cavity 20, base channel and flaps 22. Although base 14 is illustrated as a polygon, base 14 can be any shape or size. In one alternate example base 14 would still include base cavity 20 (or material housing unit 38 shown in FIG. 12) but attach and extend away from base cavity 20 (or material housing unit 38) in four directions. The four arms would be capable of folding upward for easy transport of the entire delineating device 30.

Figure 3:
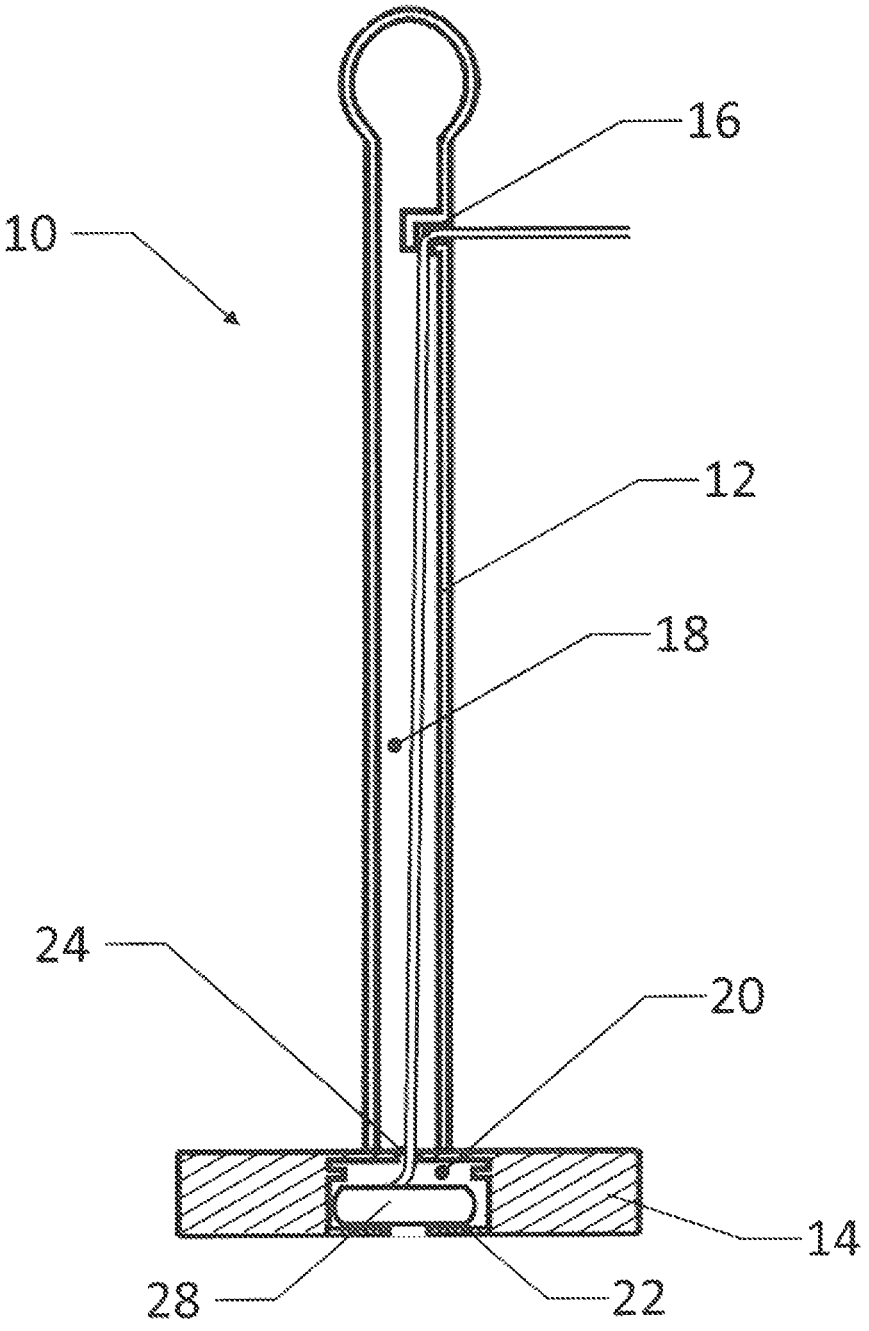
FIG. 3 is a cross-section view, showing the preferred embodiment of the present invention housing and dispensing partition material.
Figure 4:
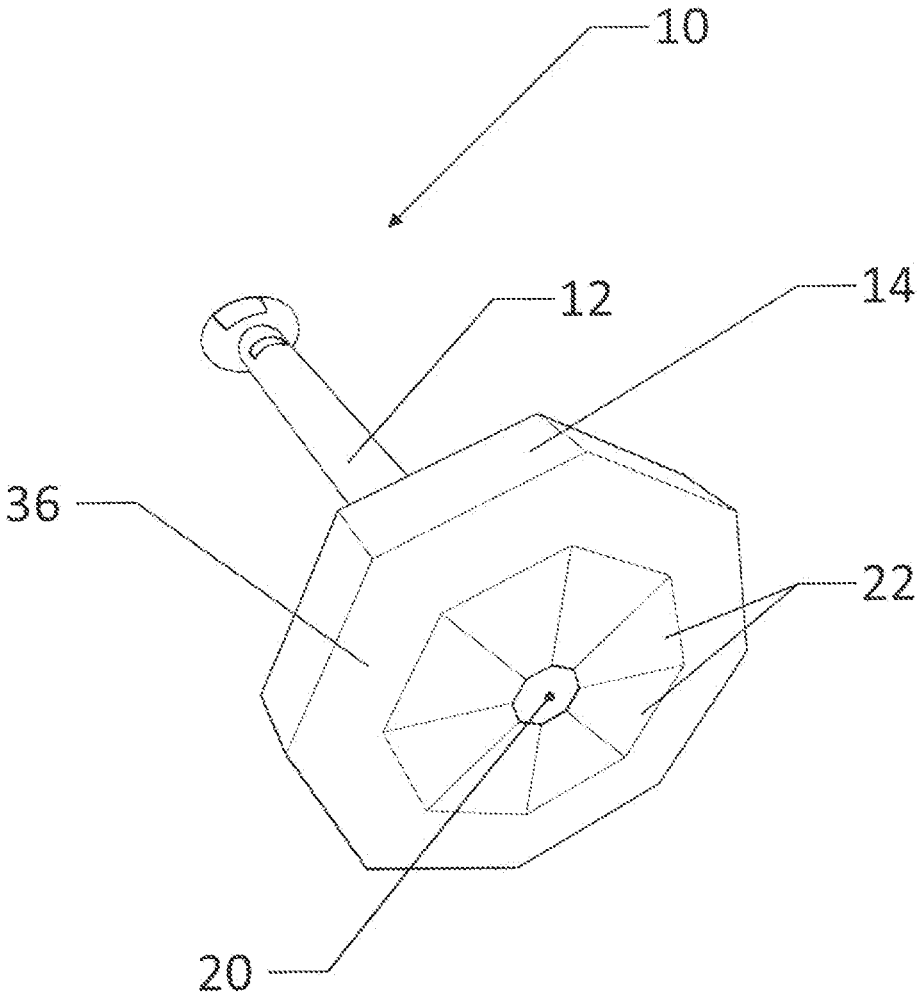
FIG. 4 is a perspective view, showing the preferred embodiment of the present invention from beneath the base.
Figure 5:
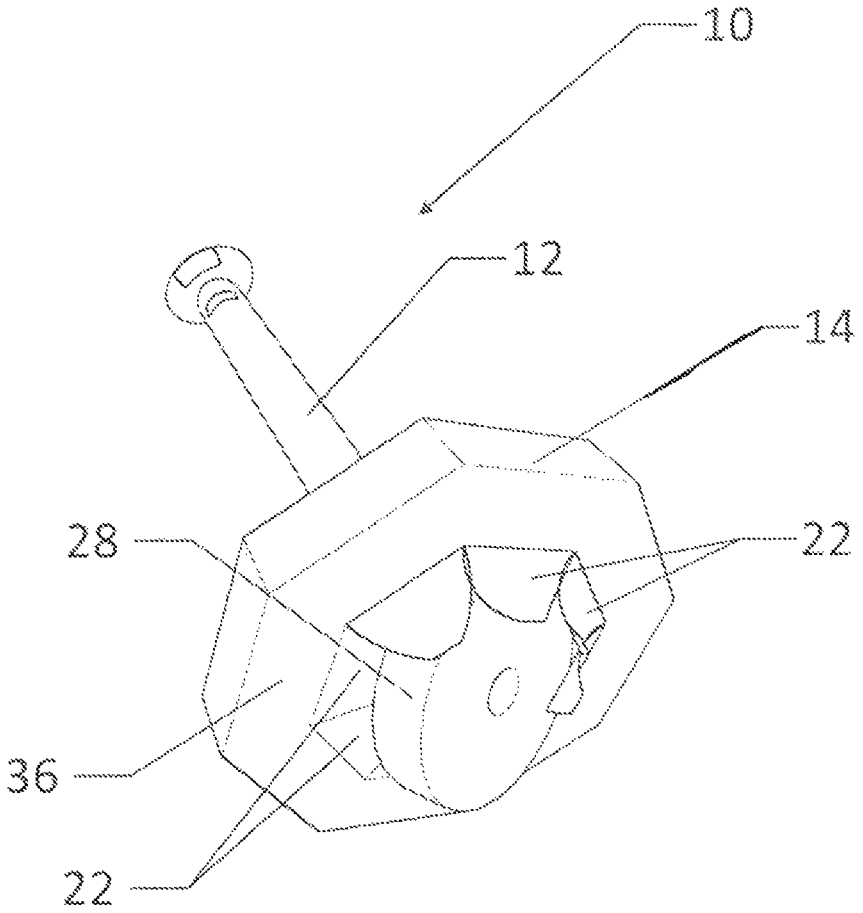
FIG. 5 is a perspective view, showing the preferred embodiment of the present invention from beneath the base with partition material being loaded into the invention.

As illustrated in FIG. 3, base cavity 20 houses partition material reel 28. Flaps 22, having a closed and open position, as shown in FIG. 4 and FIG. 5 respectively, hold partition material reel 28 inside base cavity 20. In FIG. 3, partition material 26, unspools from partition material reel 28, threads up through base channel 24, through upright member 12, via upright cavity 18, and out through exit opening 16. Partition material 26 is any light, flexible material that can be discarded after use, such as plastic caution tape or police tape, which is capable of being wrapped on a spool or reel.

Figure 6:
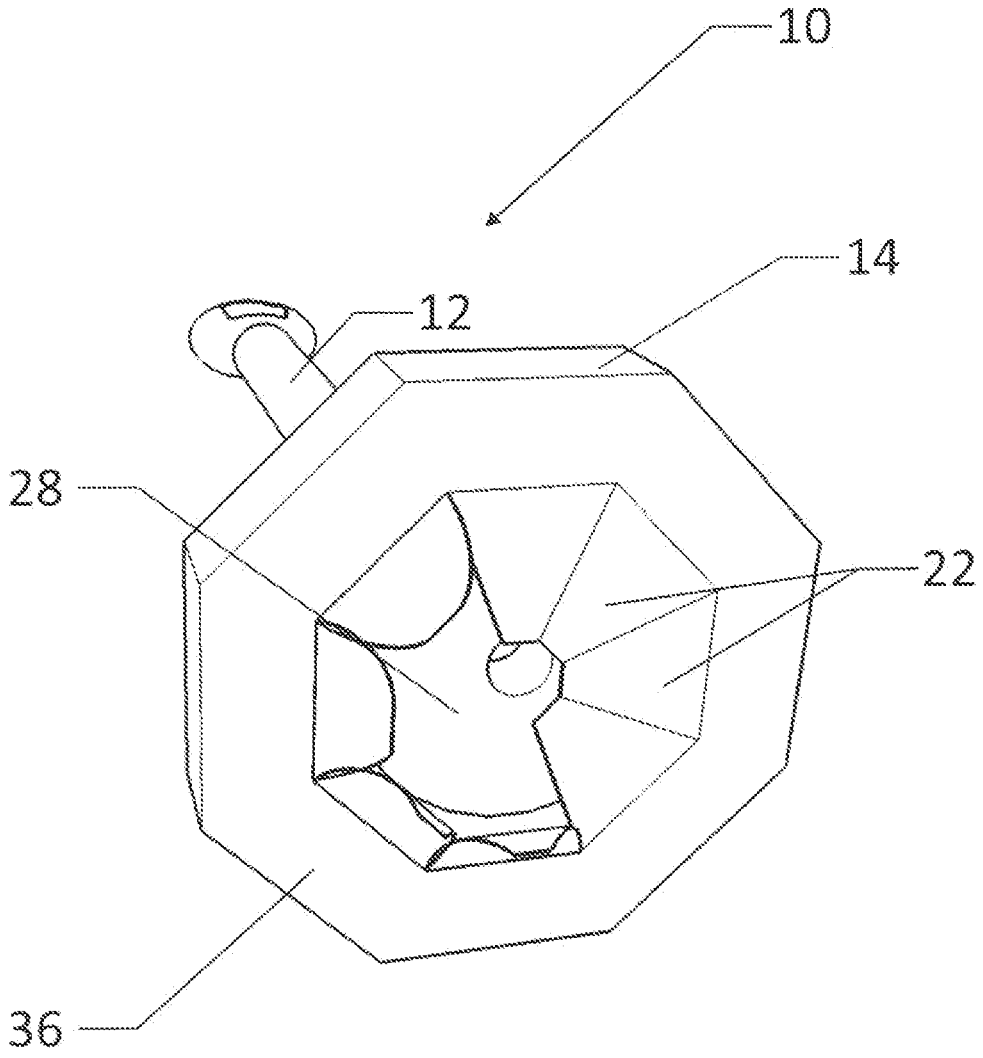
FIG. 6 is a perspective view, showing the preferred embodiment of the present invention from beneath the base with partition material nearly loaded into the base cavity.

FIG. 4 illustrates a view from beneath delineating device 10. A series of abutting flaps 22, shown here in a closed position, attach to the bottom portion 36 of base 14. In the preferred embodiment, flaps 22 almost entirely enclose base cavity 20. As shown in FIG. 5, flaps 22 open to allow a user to insert a full partition material reel 28. As partition material reel 28 is inserted into base 14, flaps 22 close around partition material reel 28, as illustrated in FIG. 6, until they are in the closed position and almost entirely enclose partition material reel 28 inside base cavity 20, as shown in FIG. 4. When partition material reel 28 is empty, the empty reel can be removed in a similar manner. In the preferred embodiment, flaps 22 are made of a thick, malleable material, such as thick rubber, that is capable of bending back to facilitate the insertion and removal of partition material reel 28, as shown in FIG. 5 and FIG. 6, but that can return to its original shape to hold partition material reel 28 inside base when in the closed position, as shown partially in FIG. 6 and in FIG. 4.

Figure 7:
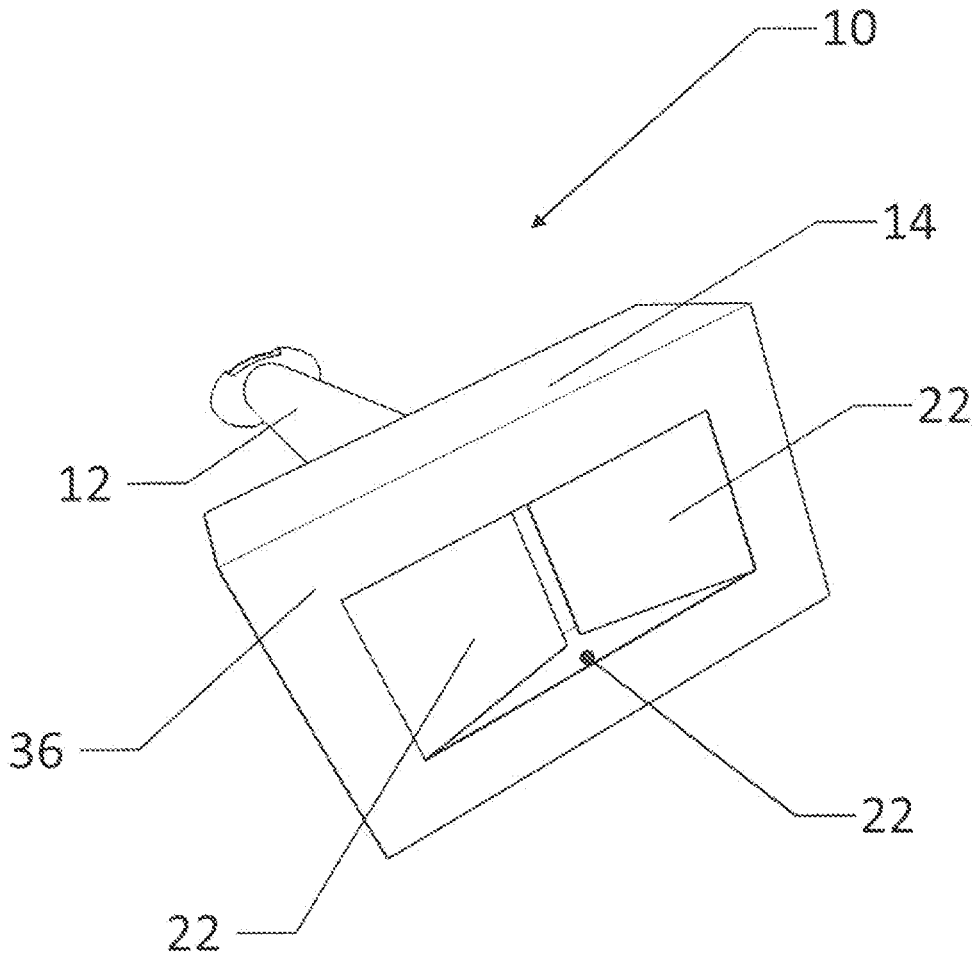
FIG. 7 is a perspective view, showing an alternate embodiment of the base of the present invention.

FIG. 7 shows a view from beneath delineating device 10 in an alternate embodiment of base 14. In this alternate embodiment, base 14 is rectangular in shape and has two flaps 22, shown in a partially open position.

Figure 8:
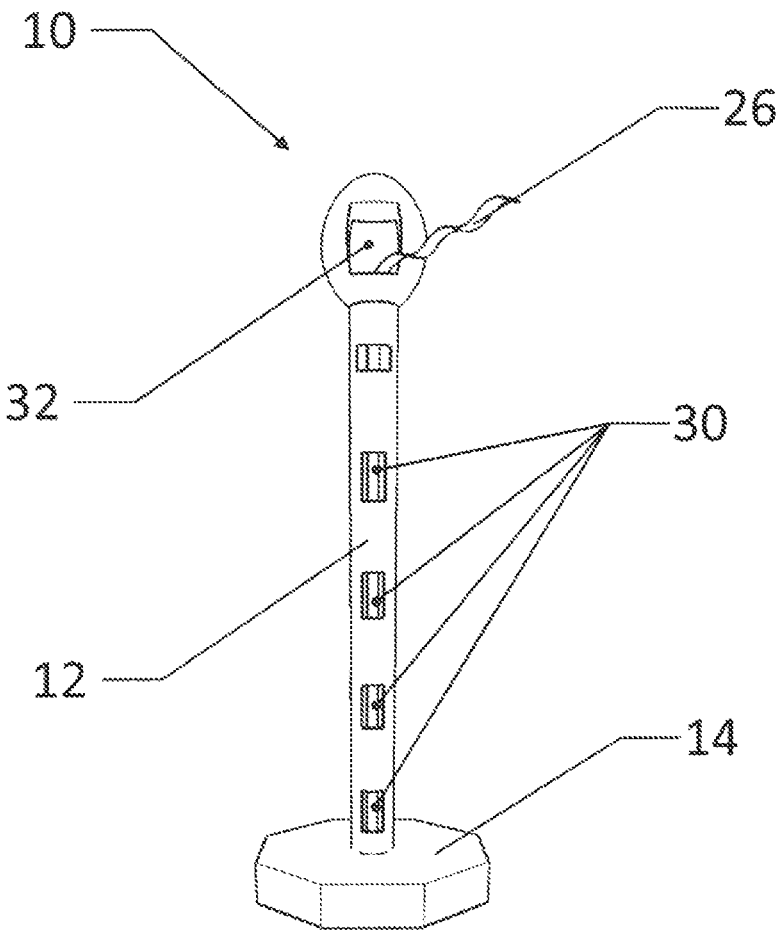
FIG. 8 is a perspective view, showing an alternate embodiment of the present invention

FIG. 8 is a perspective view of delineating device 10 showing an alternate embodiment of upright member 12. In this alternate embodiment, upright member 12 further comprises a row of lineal windows 30 advancing up the side of upright member 12. When a partition material 26 is inserted into base 14, a user can grasp partition material 26 through each of the successive lineal windows 30 from base 14 upwards to easily thread partition material 26 up through upright member 12. This alternate embodiment also shows partition material 26 exiting upright member 26 via top opening 32 as opposed to an exit point on the side of upright member 12. Thus, exit opening is defined as top opening 32 in the alternate embodiment. As further illustrated in FIG. 11, lineal windows 30 can be used to create a different series of partition patterns from partition material 26. This is accomplished by extending partition material 20 from a lineal window 30 on one upright member 12 to a lineal window 30 on a proximate upright member 12. The partition material 26 can be threaded through the lineal windows 30 in any manner that is desirable to the user, in order to accomplish a more secure delineation.

Figure 9:
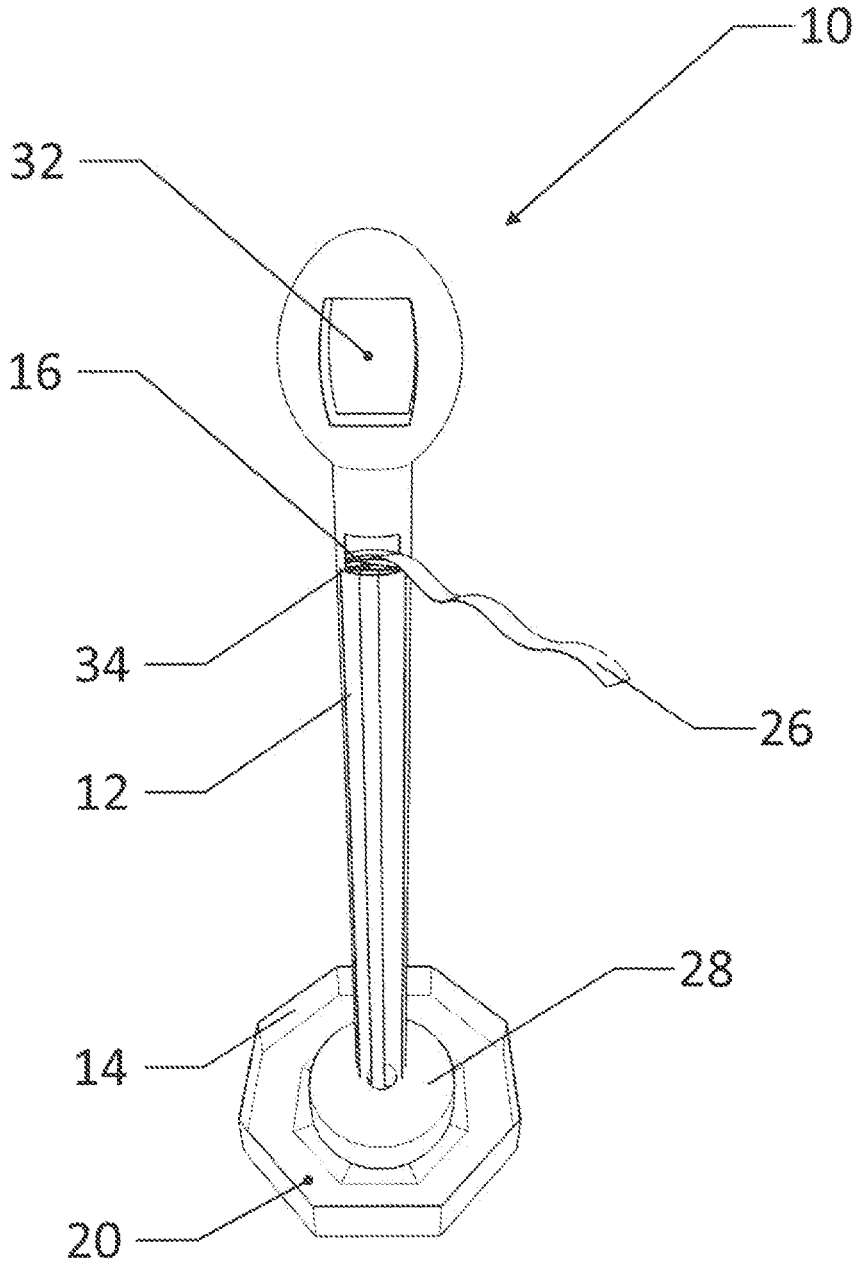
FIG. 9 is a perspective view, showing an alternate embodiment of the present invention.

FIG. 9 is a perspective view of an alternate embodiment of delineating device 10 that further comprises a brake 34 located proximate to exit opening. Brake 34 is made up of a moveable ring through which partition material 26 can be threaded. Brake 34 prevents partition material 26 from slipping back down through upright member 12 through frictional engagement by pinching down on partition material 26 as it exits upright member 12 via exit opening 15. Alternatively, brake 34 could be located proximate to top opening 32 to perform the same function in the alternative embodiment illustrated in FIG. 8 in which partition material 26 exits upright member 12 via top opening 32.

Figure 10:
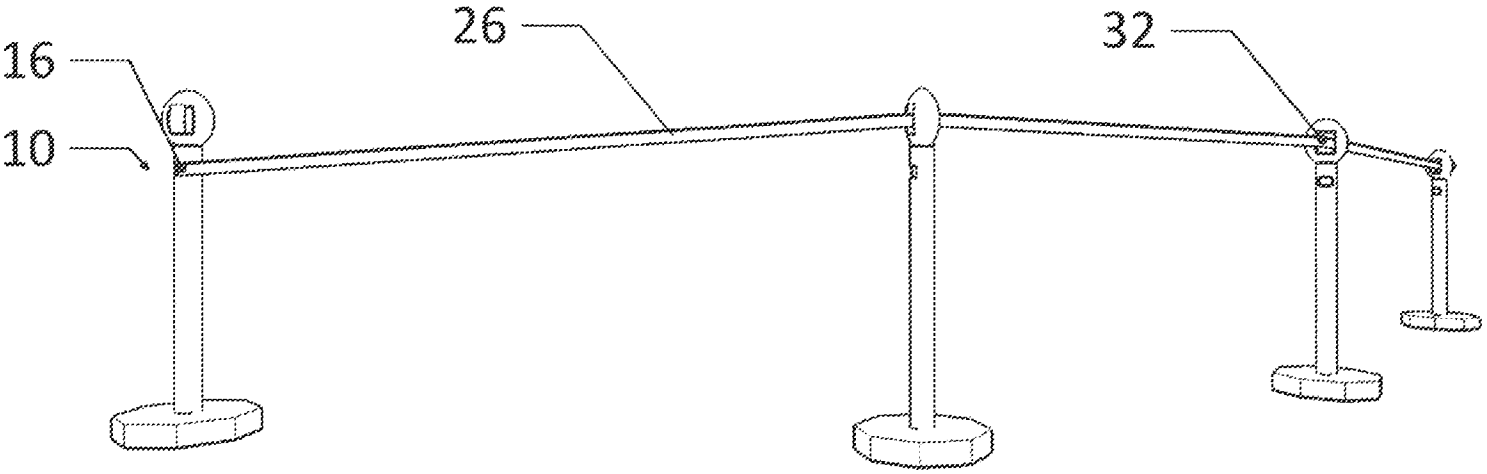
FIG. 10 is a perspective view, showing a series of the preferred embodiment of the present invention with disposable partition material dispensed.
Figure 11:
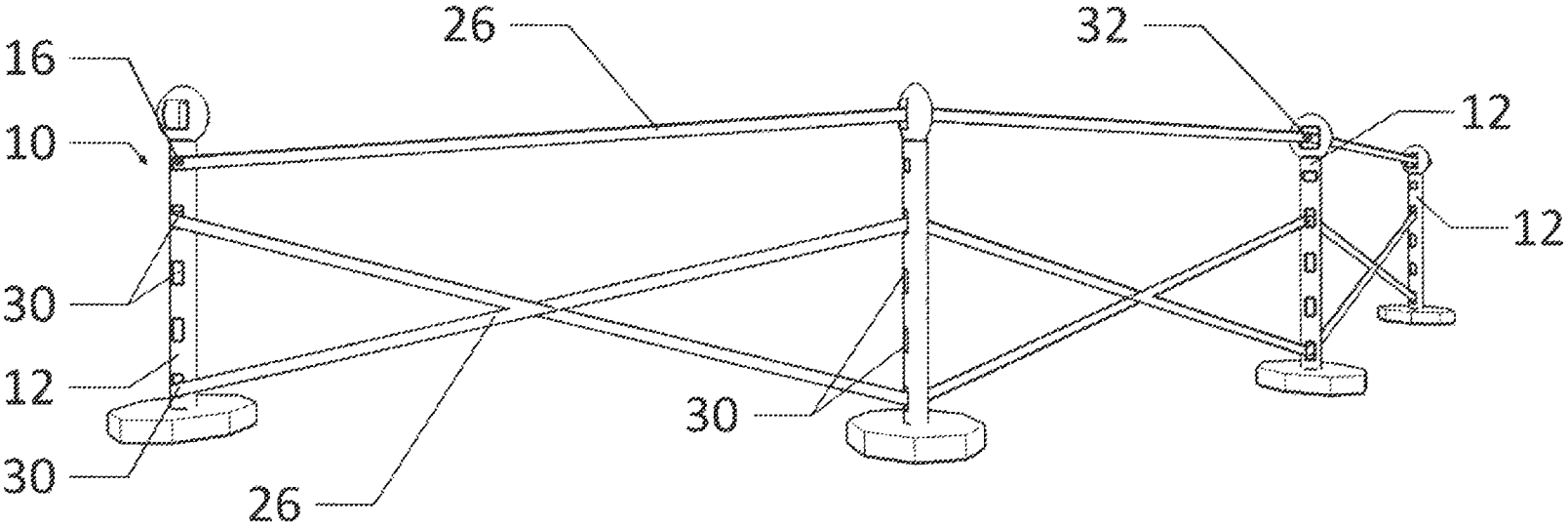
FIG. 11 is a perspective view, showing a use of an alternate embodiment of the present invention.

FIG. 10 shows a multiplicity of delineating devices 10 being used in a series to create a temporary barrier. Partition material 26 is dispensed from the fast delineating device 10 via the exit opening 16. It can then be threaded through top opening 32 of the next delineating device 10 in order to create a larger temporary delineated area. Alternatively, after being dispensed via exit opening 16 from the first delineating device 10, partition material 26 could also be affixed or tied to any other existing device, or object, such as a traffic cone, lamppost or support beam. FIG. 11 illustrates a multiplicity of delineating devices 10 showing partition material being threaded between the devices through and between the lineal windows 30.

Figure 12:
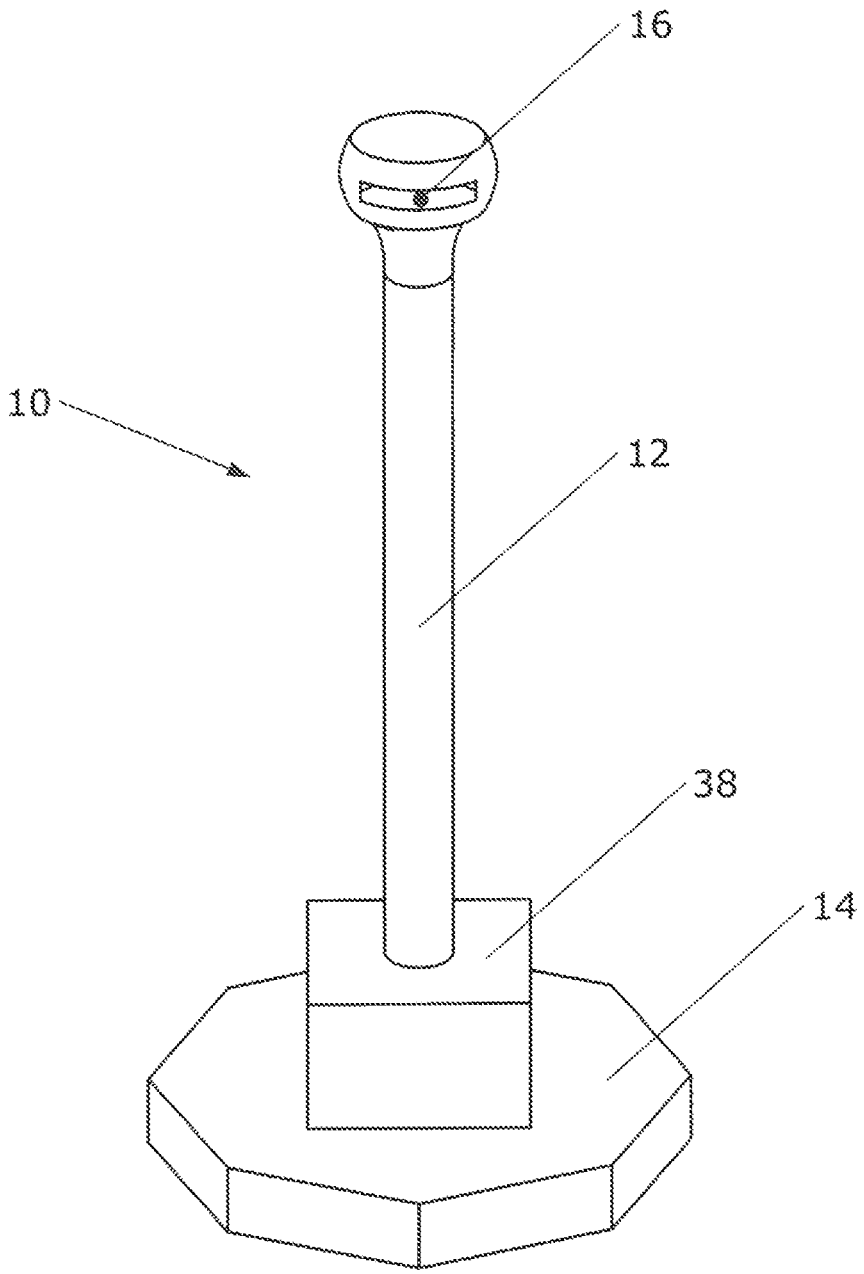
FIG. 12 is a perspective view, showing an embodiment of the present invention.
Figure 13:
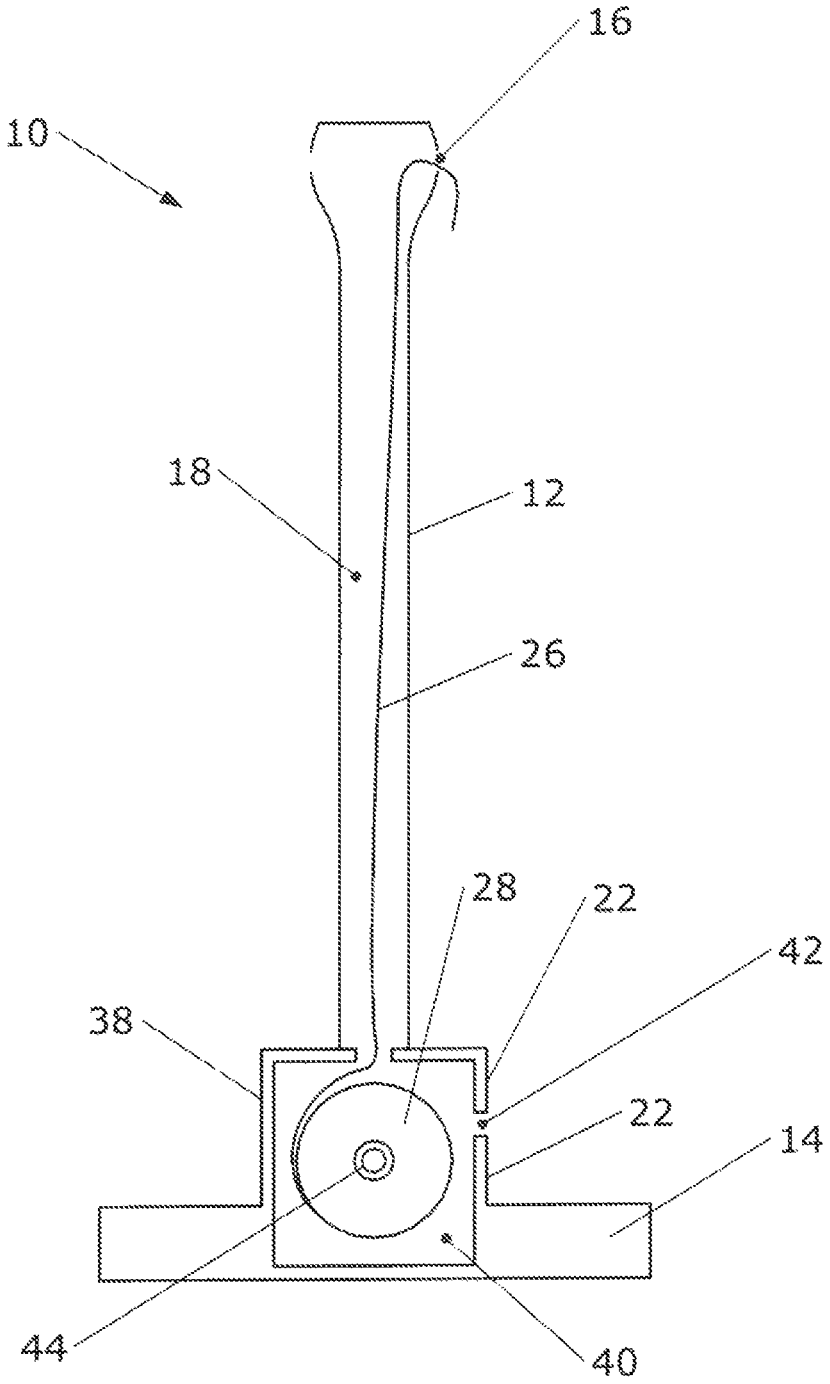
FIG. 13 is a cross section view, showing an embodiment of the present invention.

Another embodiment of the delineating device 10 is illustrated in FIG. 12. In this embodiment, the delineating device 10 comprises upright member 12, material housing unit 38 and base 14. Material housing unit 38 is attached to upright member 12 and base 14. Upright member 12 includes exit opening 16. Although material housing unit 38 is illustrated in a cube shape, material housing, unit 38 could be any shape capable of housing a partition material reel 28 (illustrated in FIG. 13). Additionally, base 14 and material housing unit 38 could include holes or openings in order to view partition material or to lighten the weight of the entire delineating device 10. FIG. 13 is a cross-section view, showing delineating device 10 in use. Partition material reel is inserted into delineating device 10 through side opening 42, which enlarges as the user pushes partition material reel 28 through flaps 22. Flaps 22 are located on the side of material housing unit 38. Partition material reel 28 is housed within material housing cavity 40 formed by material housing unit 38. Partition material reel 28 is preferably vertically oriented such that partition material 26 is capable of extending upwards through upright cavity 18 and out of exit opening 16. As one option, spindle 44 can be provided to stabilize partition material reel 28. In another option, a brake 34 is provided, such as the brake 34 illustrated in FIG. 9. Brake 34 can be provided to assist in dispensing, cutting or holding partition material in place as partition material extends out of exit opening 16.

Figure 14:
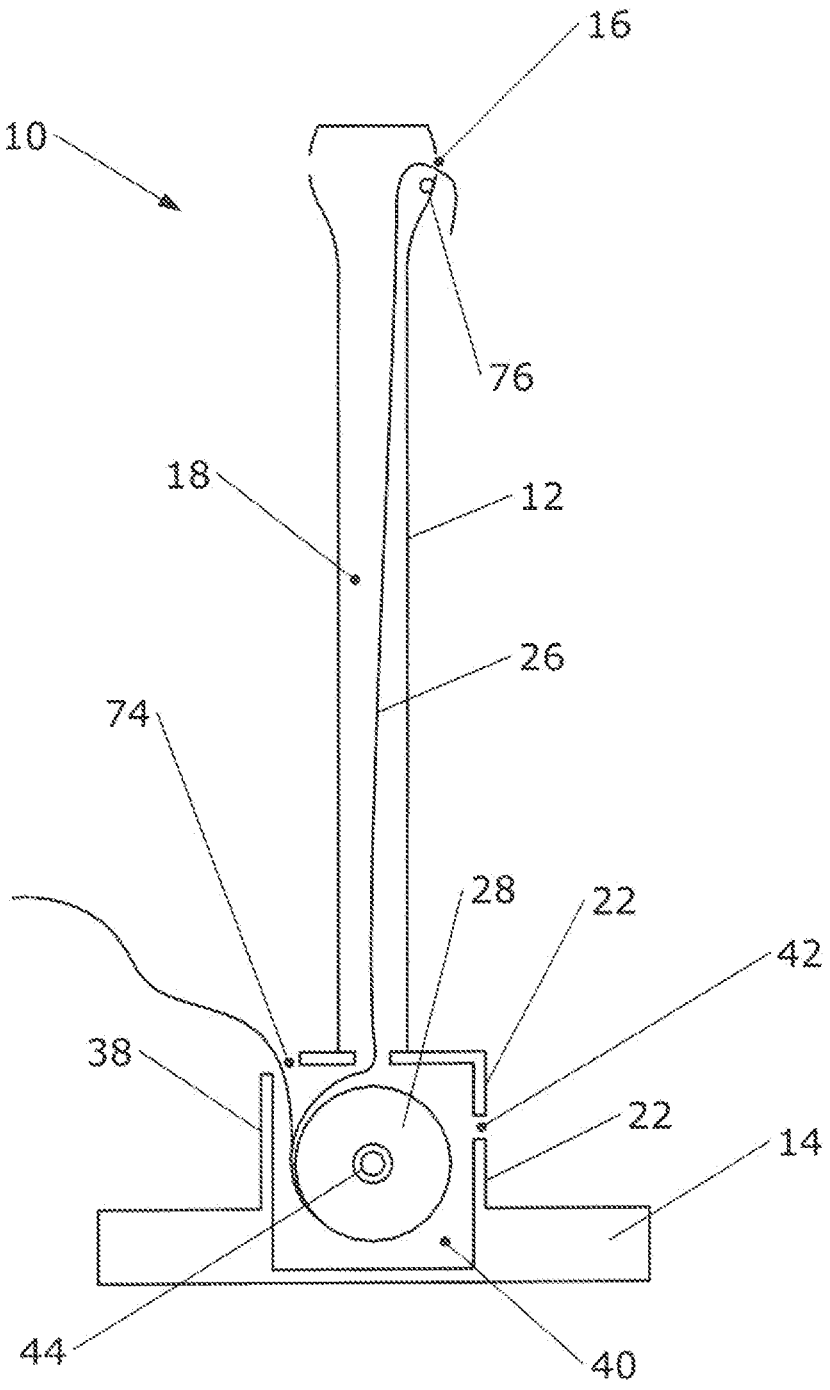
FIG. 14 is a cross section view, showing an embodiment with a direct feed port of the present invention.

A cross section view of delineating device 10 is illustrated in FIG. 14. In this embodiment material housing unit 38 includes a direct feed port 74 designed to allow the user to easily access and dispense partition material 26 from partition material reel 28. Additionally, a feed assist bar 76 is illustrated. Feed assist bar 74 can be added proximate exit opening 16 in order to ease the dispensing of partition material 26 out of exit opening 16.

Figure 15:
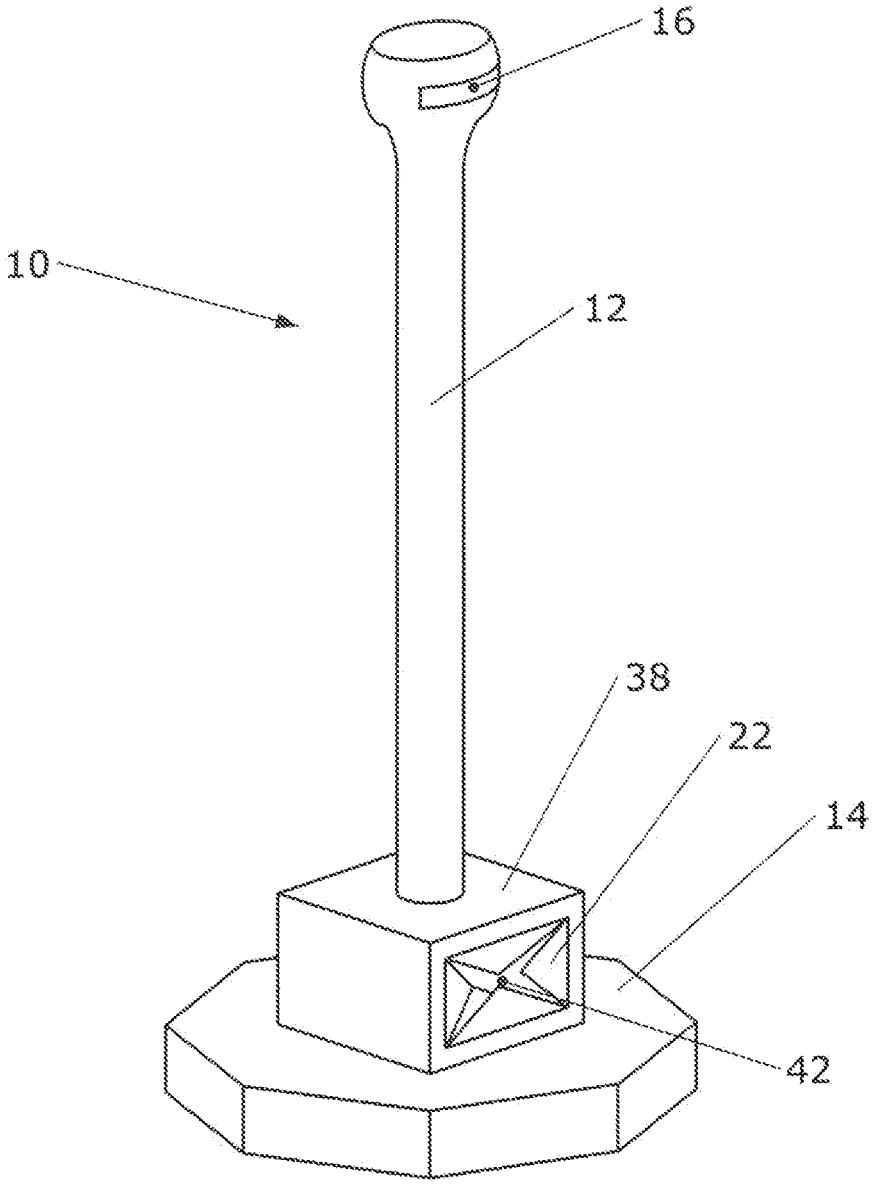
FIG. 15 is a perspective view, showing an embodiment of the present invention.
Figure 16:
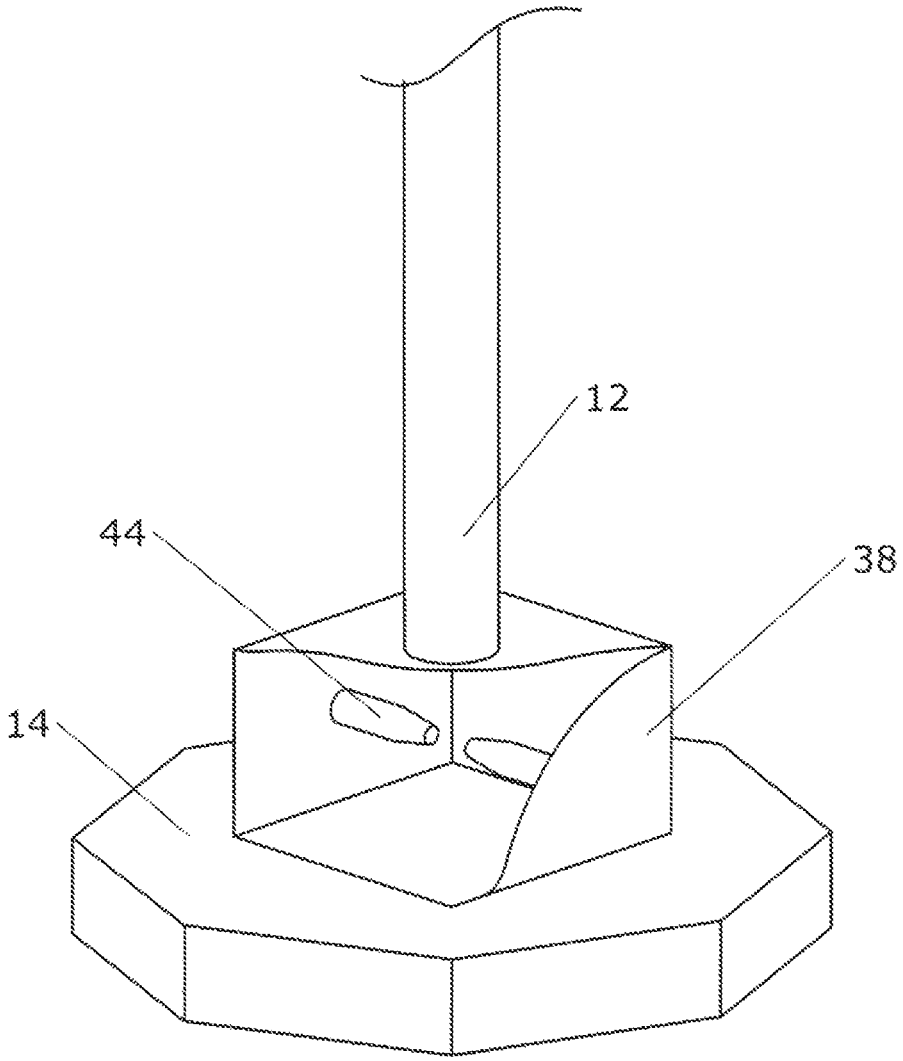
FIG. 16 is a cut away view, showing the interior of the material housing unit of the present invention.
Figure 17:
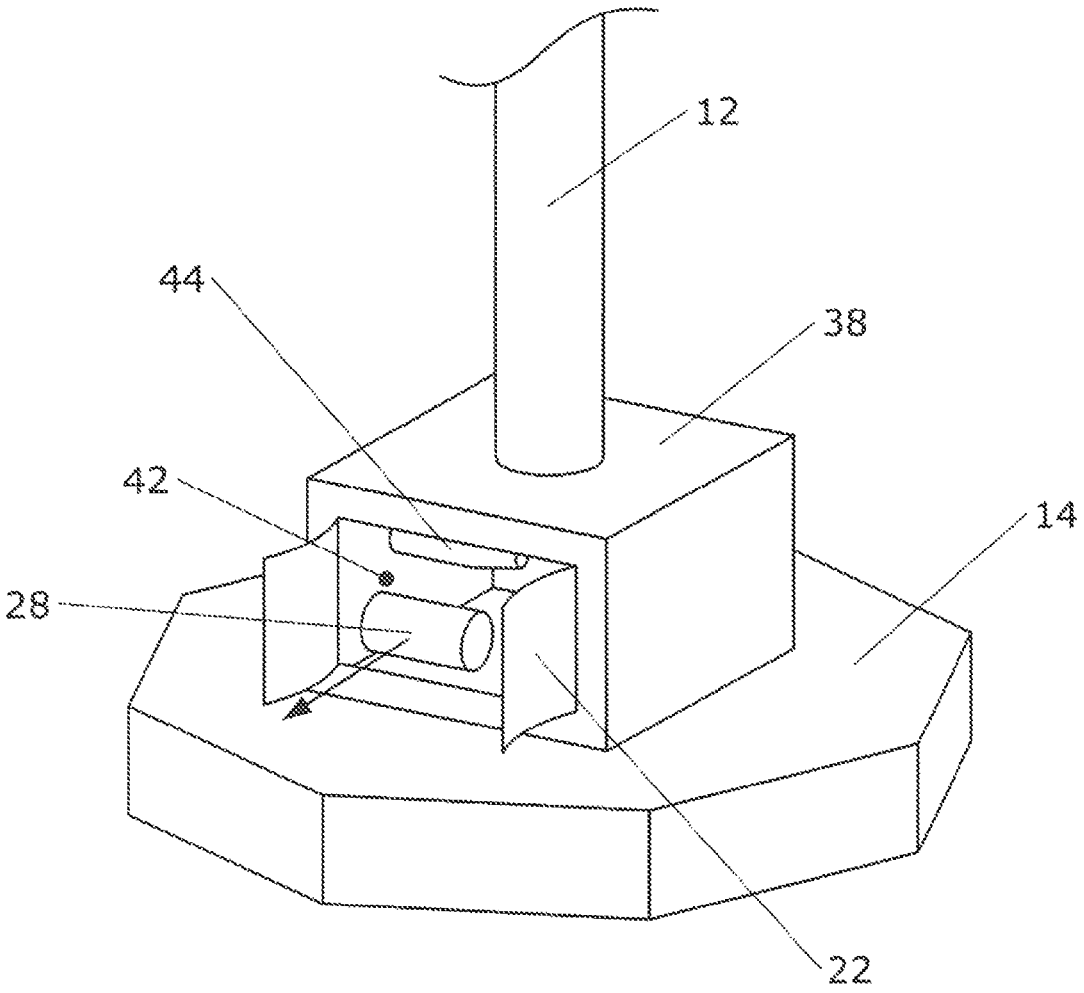
FIG. 17 is a perspective view, showing the base and material housing unit of the present invention, wherein a material reel is being removed from the material housing unit.
Figure 18:
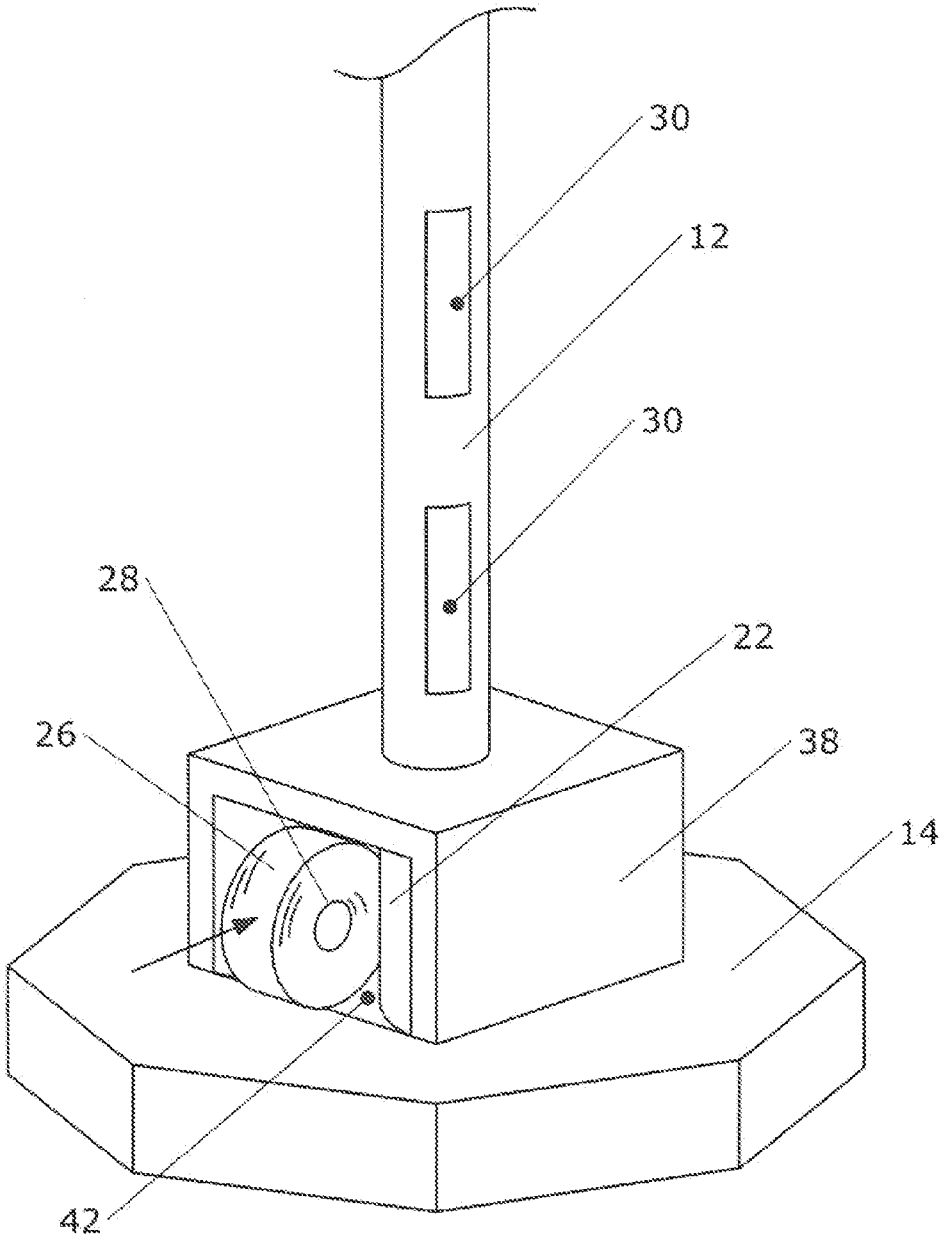
FIG. 18 is a perspective view, showing the base and the material housing unit of the present invention, wherein a material reel is being inserted into the material housing unit.

A perspective view of delineating device is shown in FIG. 15. Side opening 42 is located on the side of material housing unit 38 such that partition material reel 28 (shown in FIG. 12) can be inserted without accessing the bottom of delineating device 10. Flaps 22 can be arranged in any manner or flaps could simply be a door or a folding flap. FIG. 16 is a cut-away view of material housing unit 38. Spindle 44 is shown to stabilize partition material reel (not shown). Spindle 44 is preferably split in the middle and made of a flexible but sturdy material as rubber). The reader will appreciate that partition material reel (not illustrated) can be pushed in between split spindle 44 until the ends of spindle 44 snap back into place entering partition material reel 28 from both sides. Upon depletion of partition material 26, partition material reel 28 can be pulled out of material housing unit 38 and off of spindle 44, as illustrated in FIG. 16. The arrow in FIG. 17 illustrates the direction that the user would pull empty partition material reel 28 out of side opening 42. The step of replacing partition material reel 28 is illustrated in FIG. 18. An arrow shows the direction that partition material reel 28 is pushed through side opening 42 into material housing unit 38. Flaps 22 easily open to allow the full partition material reel 28 to be inserted into material housing unit 38. Lineal windows 30 in upright member 12 can be utilized to thread partition material 26 upwards towards exit opening (shown in FIG. 12).

Figure 19:
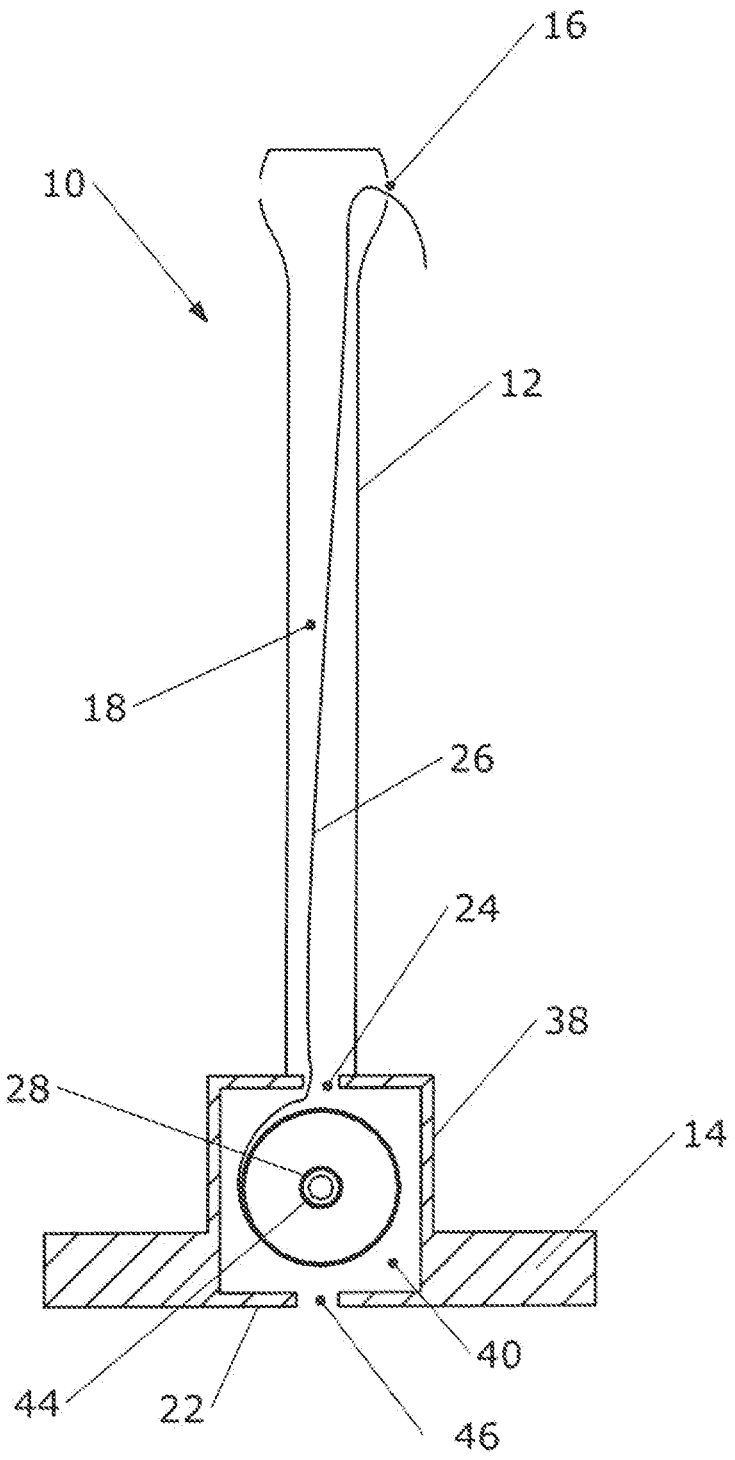
FIG. 19 is a cross section view, showing an embodiment of the present invention.

Another embodiment of delineating device 10 is illustrated in a section view in FIG. 19. Delineating device 10 includes an integrated base 14 and material housing unit 38 which together form material housing cavity 40. Base opening 46 is located on the bottom of base 14. Preferably, a series of flaps 22 cover base opening 46 such that if base 14 is lifted off of a surface, flaps 22 are capable of keeping partition material reel 28 inside of material housing cavity 40. Partition material reel 28 is inserted into material housing cavity 40 by pushing partition material reel 28 through base opening 46. Partition material reel 28 is oriented vertically within material housing cavity 40.

Figure 20:
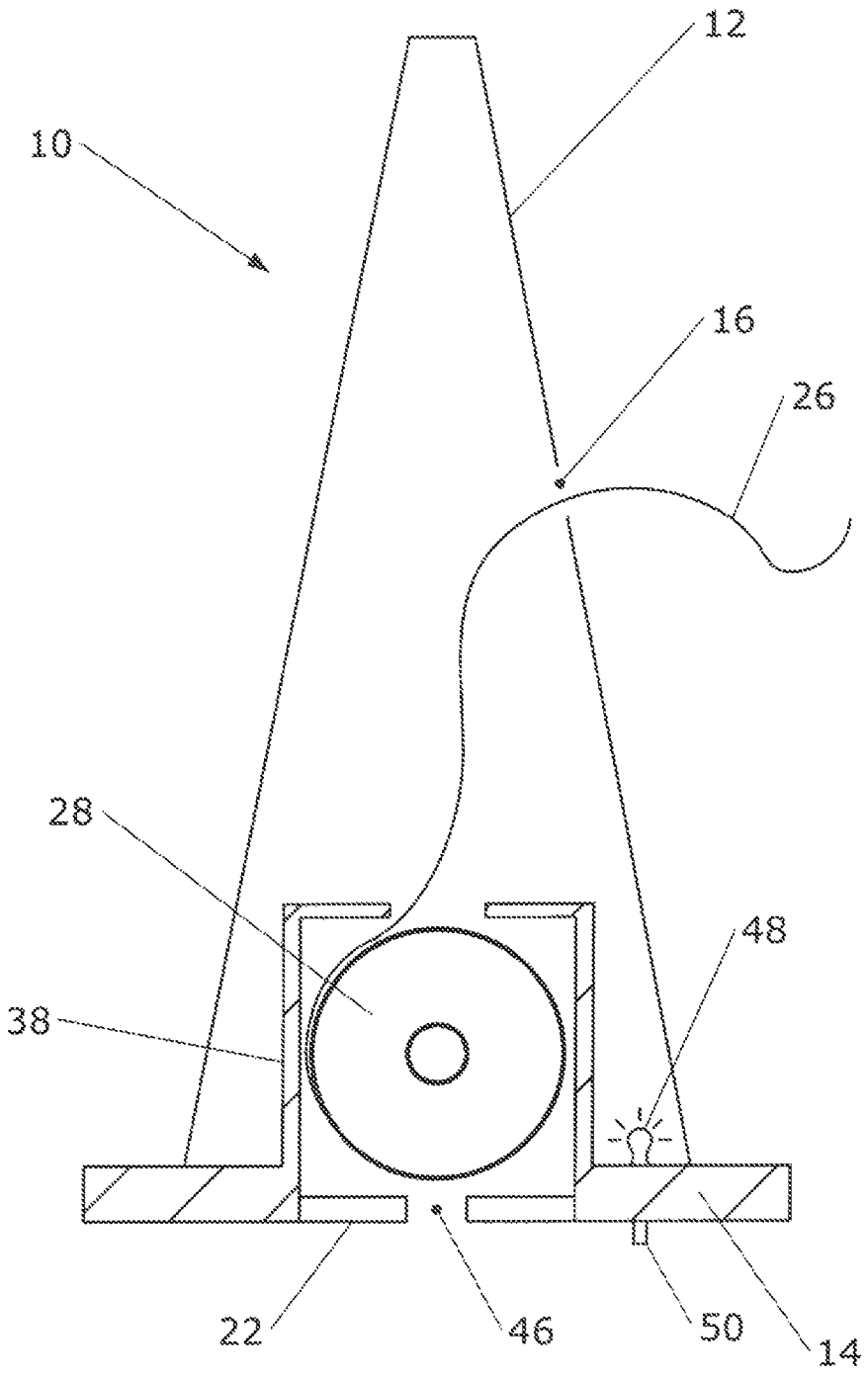
FIG. 20 is a cross section view, showing an embodiment of the present invention.
Figure 21:
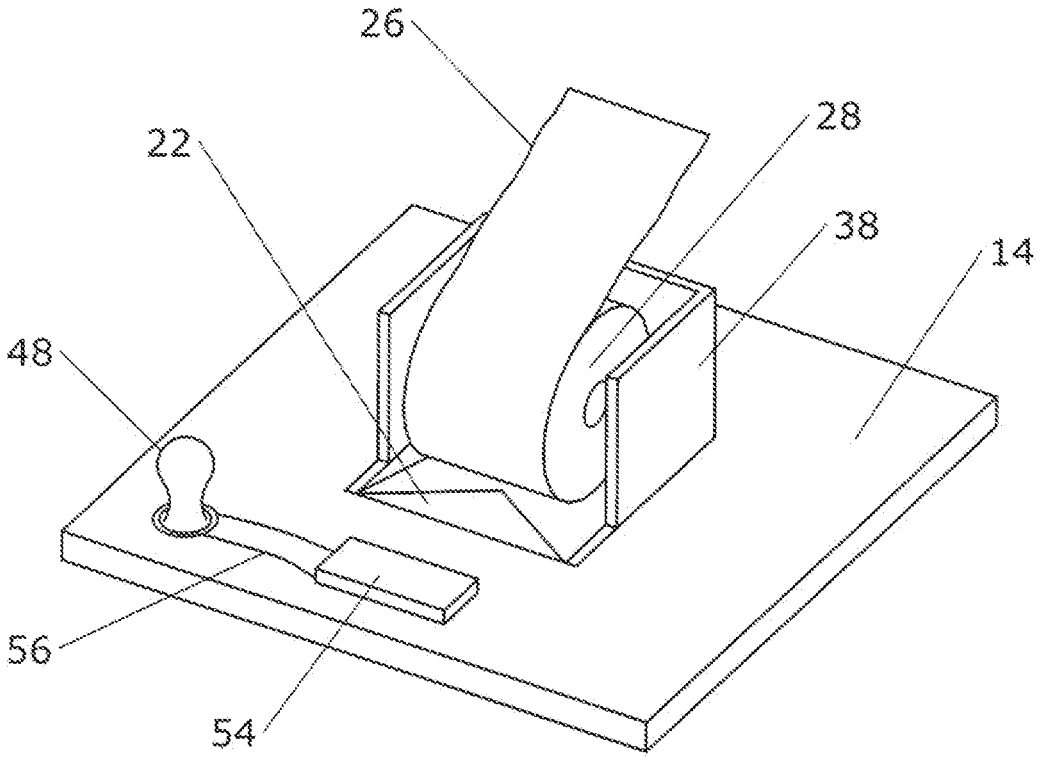
FIG. 21 is a perspective view, showing the base and material housing unit of an embodiment of the present invention.
Figure 22:
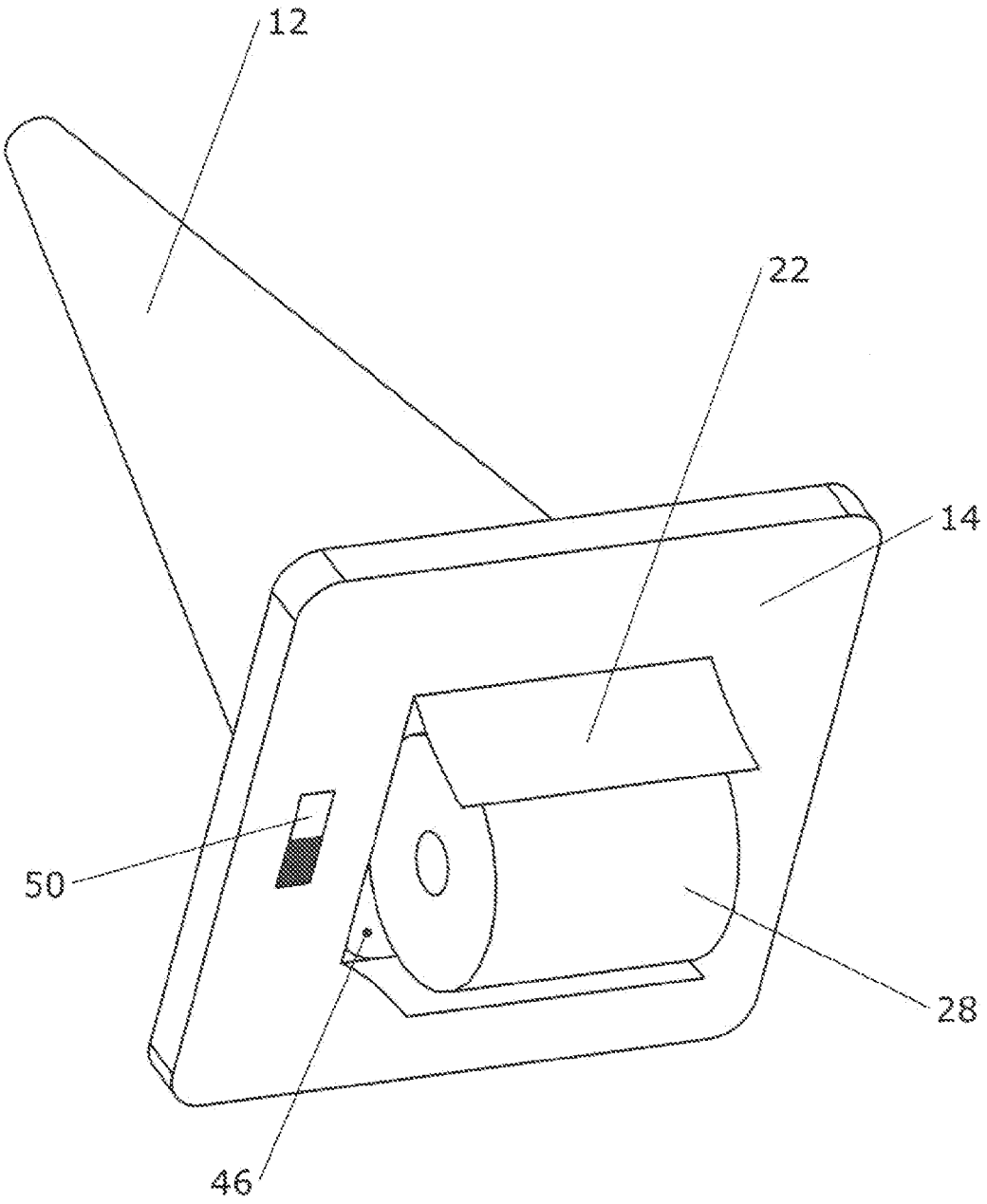
FIG. 22 is a perspective view, showing a view from the bottom of an embodiment of the present invention.
Figure 23:
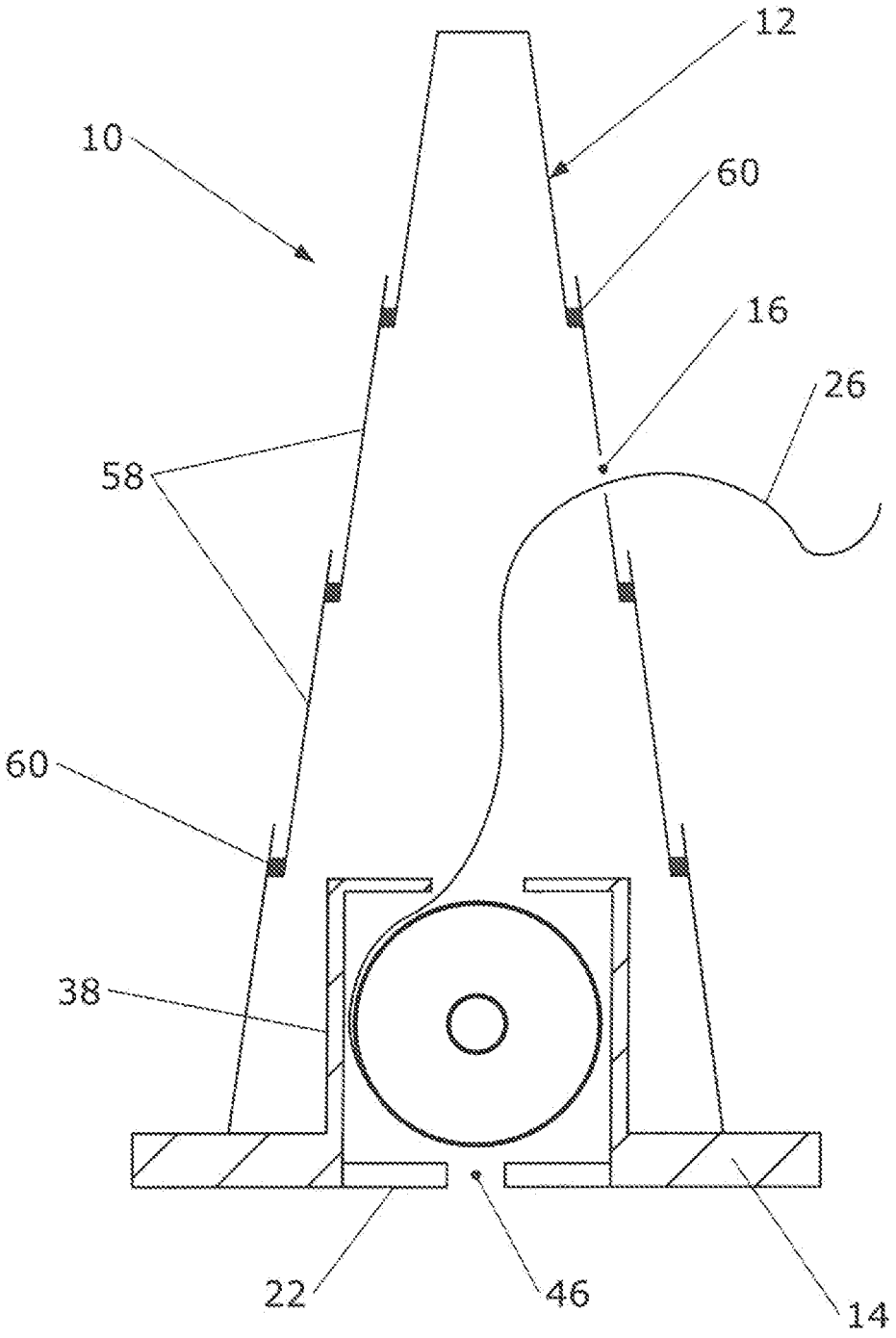
FIG. 23 is a cross section view, showing an embodiment of the present invention wherein the upright member is collapsible.

An alternate embodiment of delineating device 10 is shown in FIG. 20. Delineating device 10 still includes upright member 12, material housing unit 38 and base 14. Upright member 12 is cone-shaped and includes exit opening 16. Base 14 is attached to upright member 12 and includes a base opening 46. Similar to the other embodiments described herein, base opening 46 is preferably covered by a series of flaps 22. Partition material 26 is fed up through exit opening 16. An access port (not illustrated) can be provided to assist in feeding partition material 26 op to exit opening 16. Partition material reel 28 is depleted by pulling partition 26 material 26 through exit opening 16 for use on roadways, construction sites or other areas that require partitioning. After the partition material 26 is depleted, empty partition material reel 28 is capable of being removed through base opening 46 and replaced with a full partition material reel 28. Light 48 is included within cavity of upright member 12 of delineating device 10 to illuminate delineating device 10. Upright member 12 (cone) is preferably collapsible and made up of a material that is translucent enough to allow the light to illuminate the device. Light 48 is activated by switch 50. Switch 50 can be located anywhere on the delineating device 10 and is wired to light 48. Material housing unit 38 is configured to support partition material reel 28. Material housing unit 38 can be made of any material, but is preferably made of a plastic or rubber fully integrated with base 14. FIG. 21 illustrates a view of the cone-shaped embodiment with the upright member (not shown) stripped away. Base 14 includes light 48 connected to battery 54 with wiring 56. Switch (not shown) is preferably in an easily accessible position such that the user can turn the light 48 on and off with little effort. Partition material reel 28 sits vertically oriented within material housing unit 38 (cut away to show material reel). Material housing unit 38 can be embedded or integral with base 14. Flaps 22 separate partition material reel 28 from the surface that base 14 rests upon. FIG. 22 is a view from underneath of base 14 of delineating device. Partition material reel 28 can be removed and replaced with a second partition material reel through flaps 22. Switch 50 is optionally located on the bottom of base 14. Upright member 12 can be any shape or configuration. As an example, FIG. 23 illustrates one embodiment in which upright member 12 is comprised of a series of flexible members 58 with stops 60. Flexible members 58 can fully collapse onto base 14 such that delineating device 10 is easily transportable. Stops 60 assist in maintaining the shape of the upright member 12 when in a fully extended position.

Figure 24:
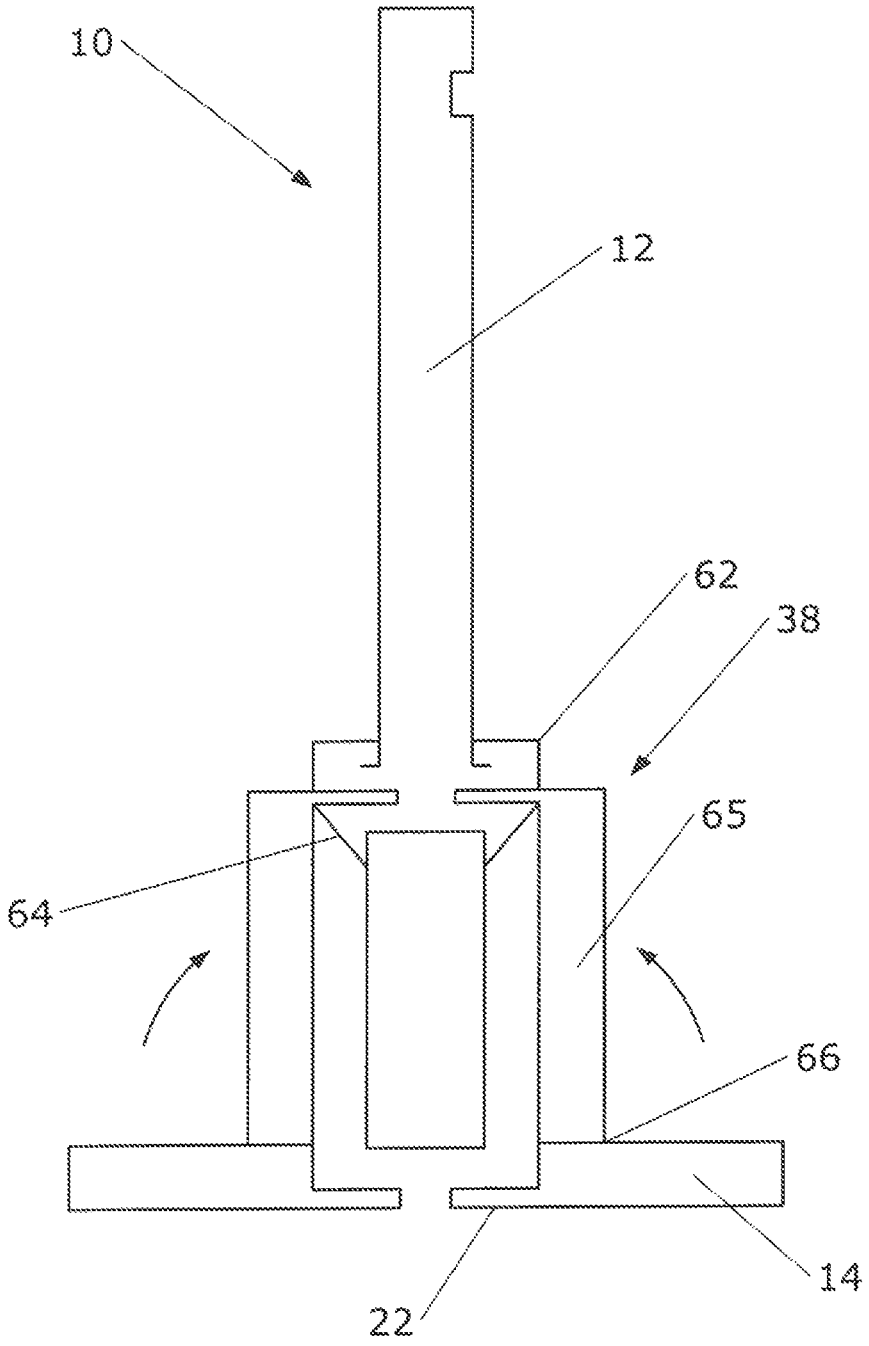
FIG. 24 is a cross section view, showing an embodiment of the present invention wherein the material housing includes stabilizing members that support material reel.
Figure 25:
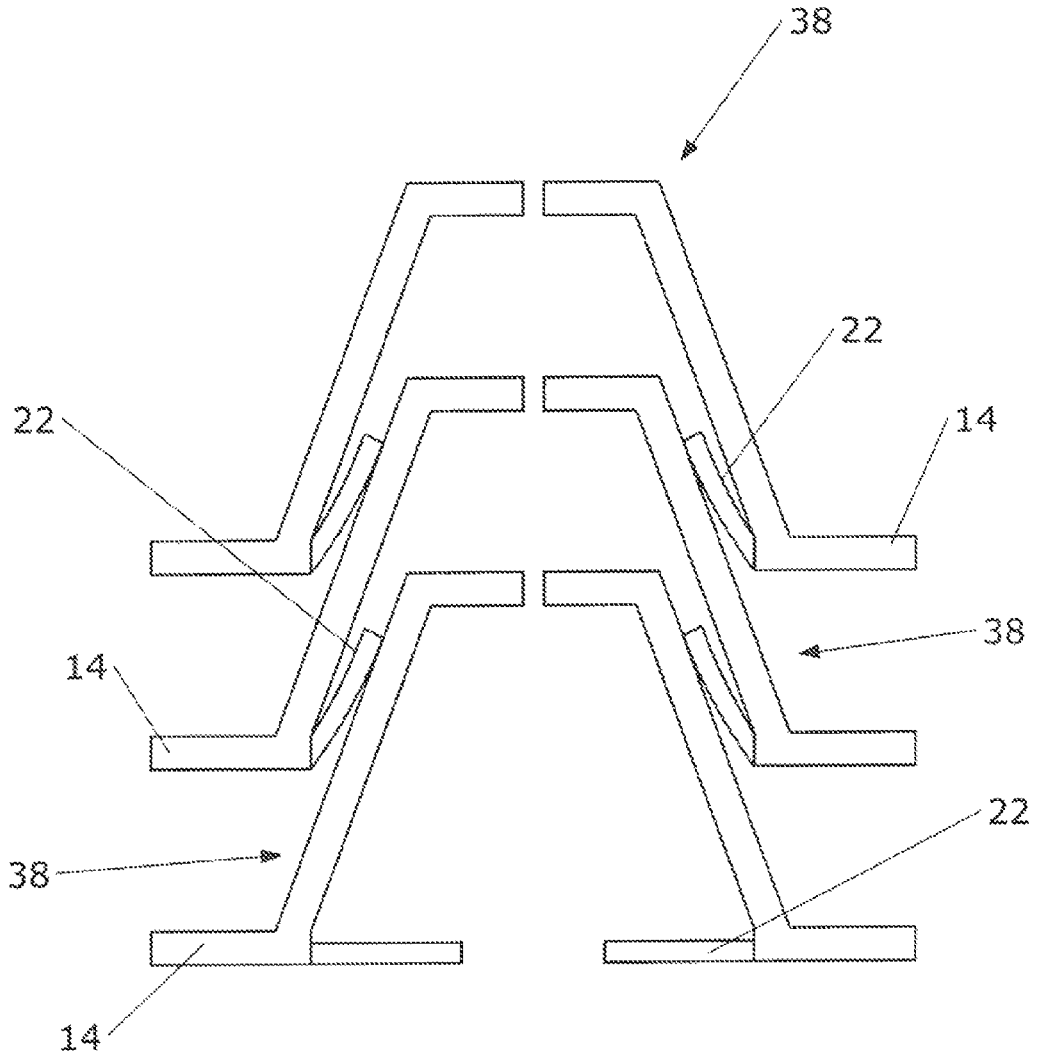
FIG. 25 is a perspective view, showing multiple base members of the present invention stacked.
Figure 26:
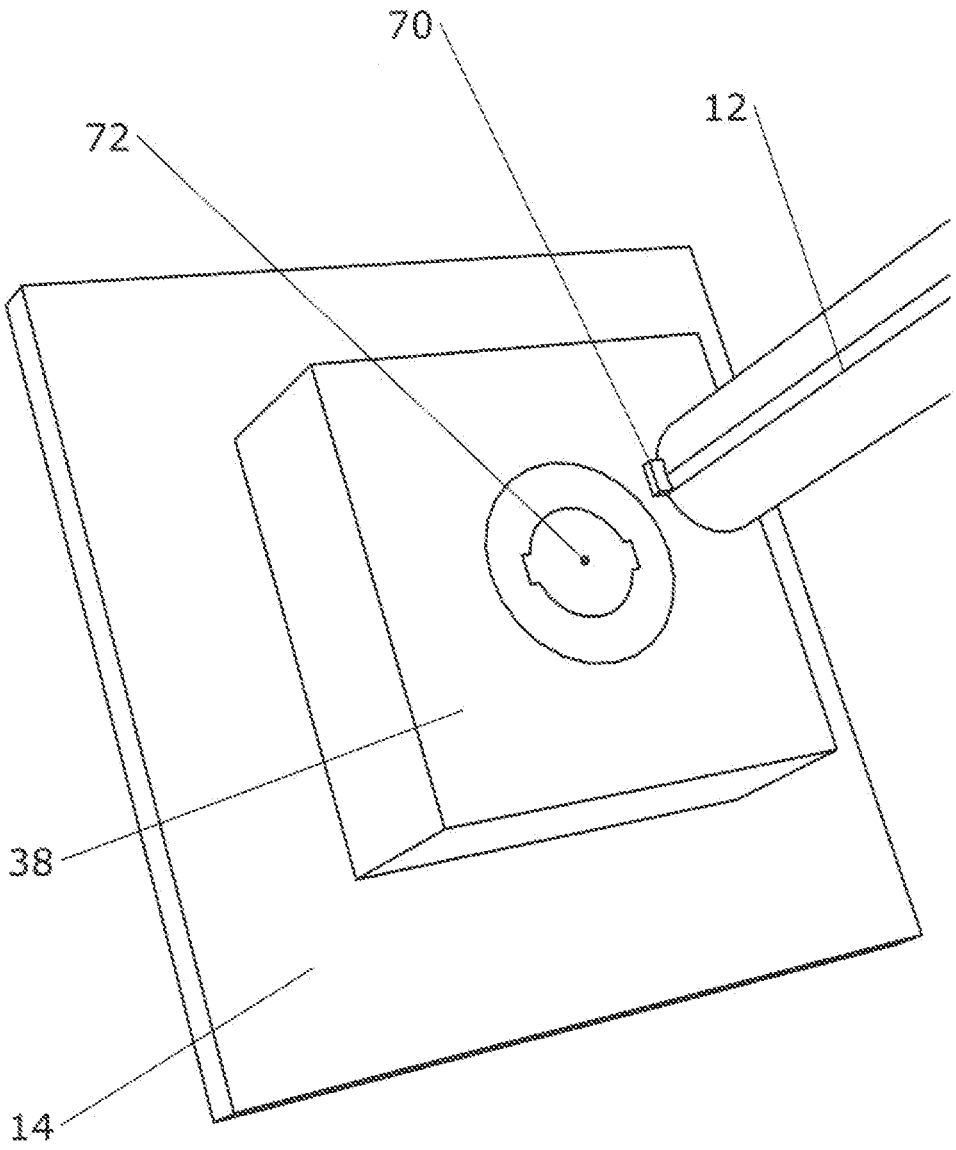
FIG. 26 is a perspective view, showing the insertion of upright member in material housing unit of an embodiment of the present invention.

FIG. 24 illustrates an embodiment of delineating device 10 which can be disassembled. As shown, delineating device 10 includes upright member 12 removably attached to a coupling 62 which is attached to material housing unit 38. Material housing unit 38 is illustrated as a cube; however material housing unit 38 can be designed in any shape that allows partition material reel 28 to fit within it. Additionally, the outer walls of material housing unit 38 can be beveled such that once upright member 12 is removed, base 14 and material housing unit 38 can be stacked. The stackability of bases is illustrated in FIG. 25. The reader will appreciate that beveling can be applied where the material housing unit 38 is in a horizontal oriented position. As shown in FIG. 26 upright member 12 is disassembled from material housing unit 38 by twisting and removing upright member 12. Tabs 70 are provided at the lower end of upright member 12 to engage with material housing unit 38. Once tabs 70 are inserted into void 72, upright member 12 turns to lock into place. Although tabs 70 are provided in order to lock upright member 12 into place, any known mechanism for engaging and disengaging upright member 12 can be used.

Figure 27:
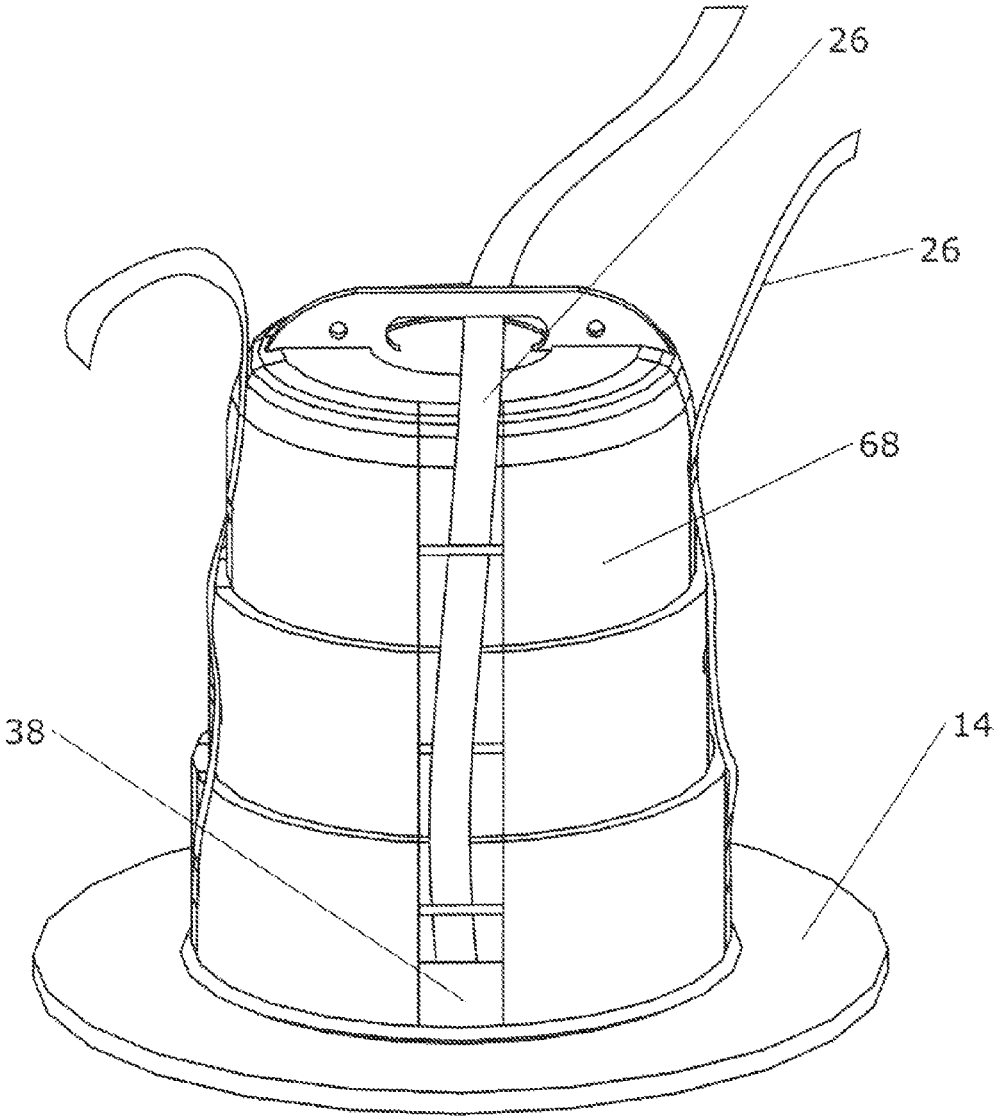
FIG. 27 is a perspective view, showing an embodiment of the present invention having four material housing units for dispensing material from a material reel.
Figure 28:
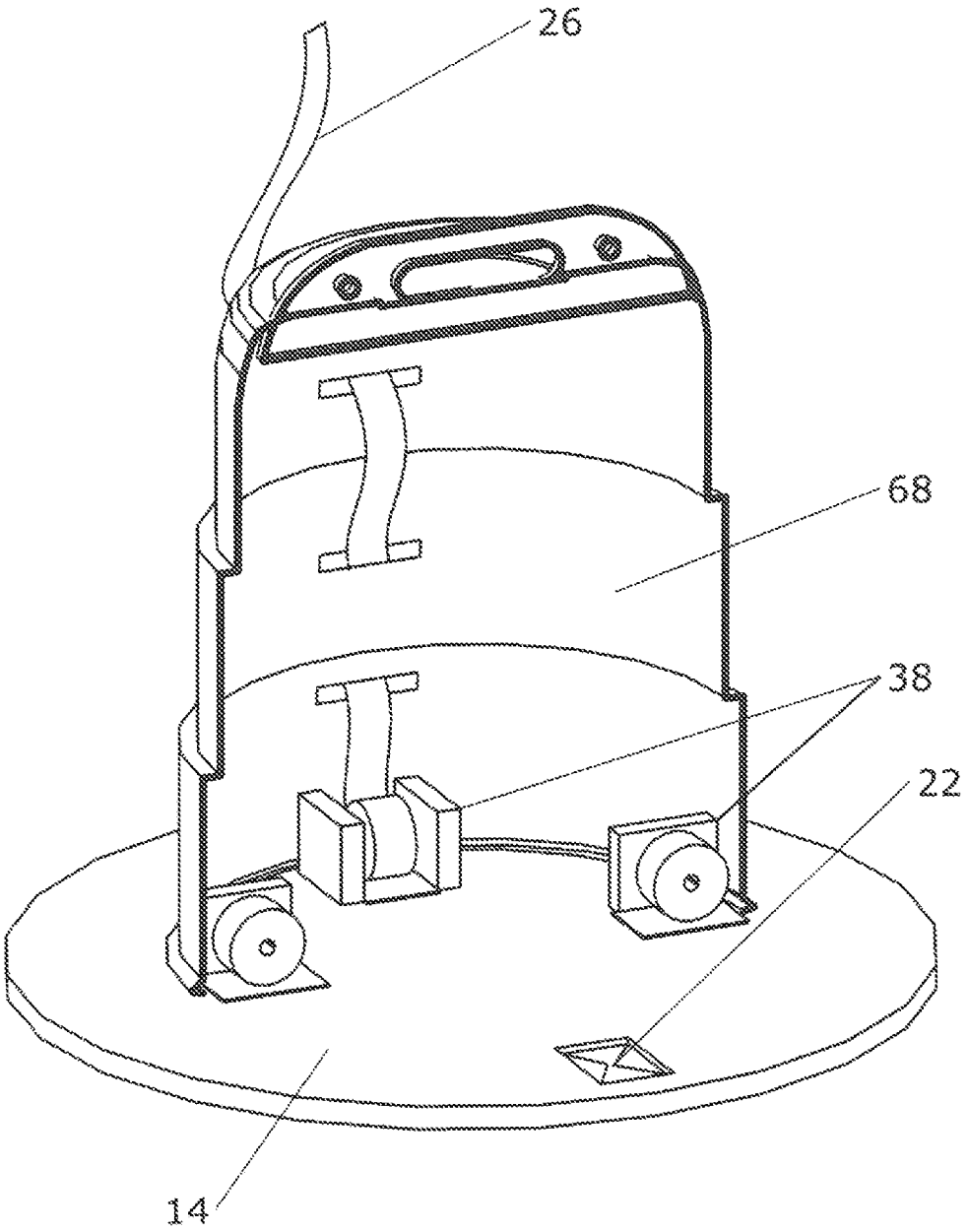
FIG. 28 is a cut away view, showing an embodiment of the present invention having four internal material housing units to dispense material from a material reel.
Figure 29:
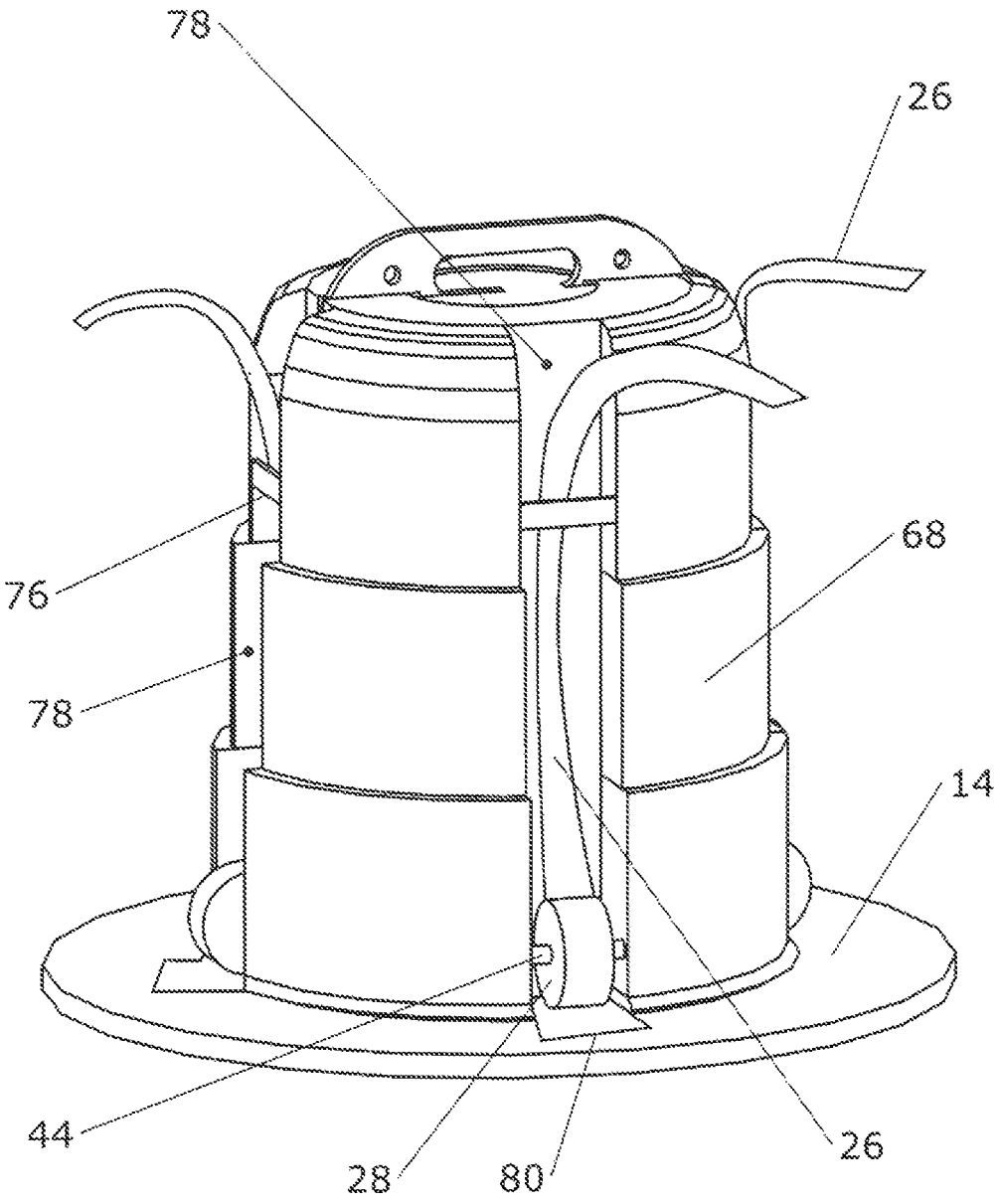
FIG. 29 is a perspective view, showing an embodiment of the present invention having the material housing reels external to the barrel.
Figure 30:
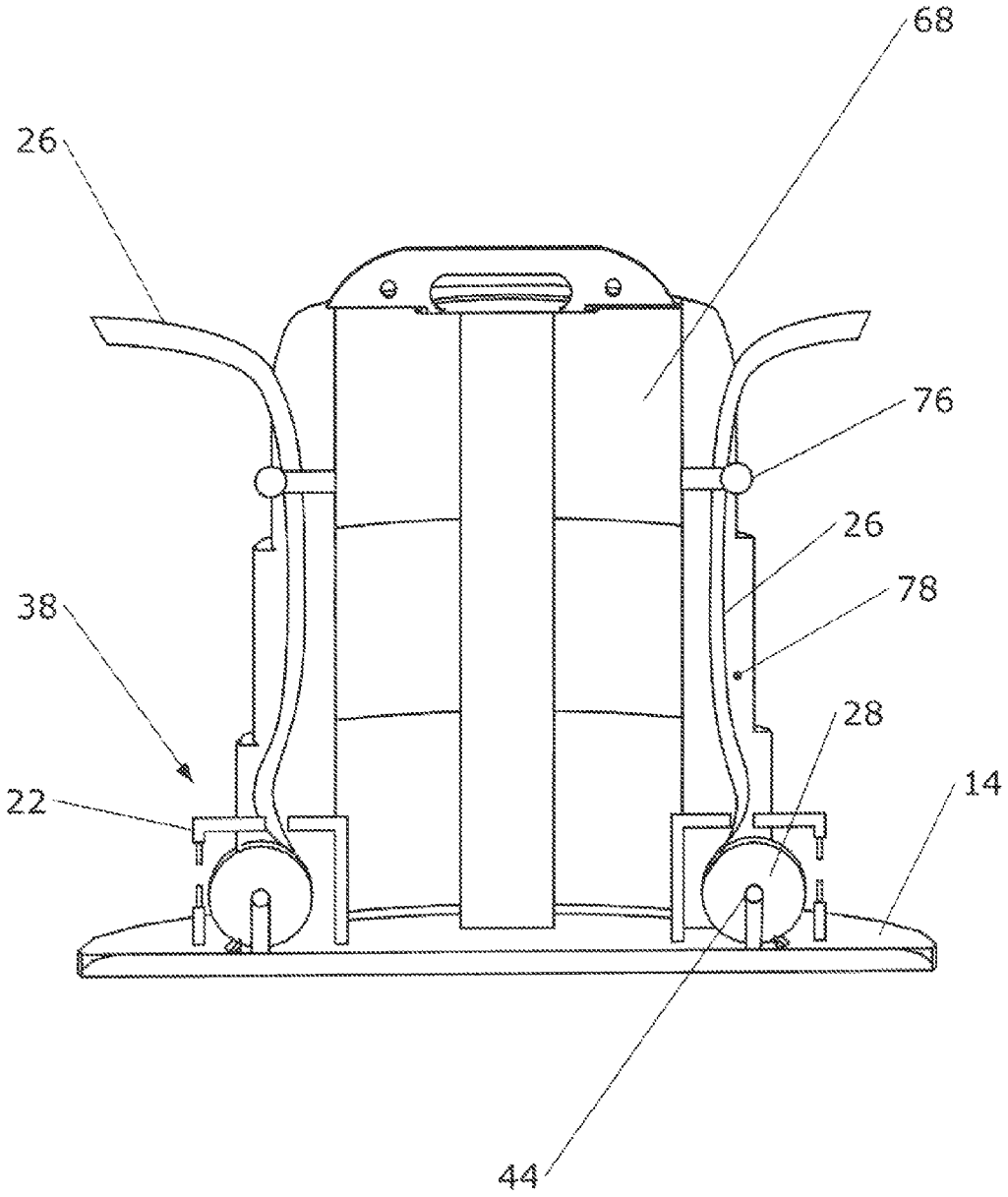
FIG. 30 is a cut away view, showing the internal view of an embodiment of the present invention.

A barrel is provided as upright member 12 in FIG. 27-30. Barrel 68 includes an internal cavity that can includes four material housing units 38 which can all accept partition material reels, as illustrated in FIGS. 27 and 28. Each material housing unit 38 within internal cavity of barrel 68 includes a base opening with flaps 22 covering the opening such that partition material reel 28 can be inserted into position and removed easily. Partition material 26 can extend along any side of barrel 68 in order to link with other barrels, delineators or other structures. FIGS. 29 and 30 illustrate barrel 68 with four partition material reels located outside of barrel 68. FIG. 29 is a perspective view with the material housing units 38 stripped away to show the location and seating of partition material reels 28. Partition material reels 28 rest in a groove 80 designed to cradle partition material reel 28. Spindle 44 is optionally provided to allow partition material reel 28 to spin freely. An exposed channel 78 runs along four sides of the barrel 68. Partition material 26 runs upward within exposed channel 78 through a feed assist bar 76. FIG. 30 illustrates a cut away view of the barrel 68 with external material housing units 38.

The preceding description contains significant detail regarding the novel aspects of the present invention. It should not be construed, however, as limiting the scope of the invention but rather as providing illustrations of the preferred embodiments of the invention. As an example, the base 14 could be any number of different shapes. Additionally, exit opening 16 could be located at the top of the upright member 12. Thus, the scope of the invention should be fixed by the following claims, rather than by the examples given.

The invention claimed is:

1. A method of using a delineating device to dispense an amount of partition material on a partition material reel, comprising the steps of:

providing said delineating device comprising an upright member, having a cavity and an exit opening; a base attached to said upright member, having a material housing unit, a mate at housing cavity and an opening;

inserting said partition material reel into said material housing cavity through said opening such that said partition material is capable of extending upward from said base through said cavity of said upright member and out of said exit opening;

depleting said partition material;

removing said partition material reel once said partition material is depleted by pulling said partition material reel through said opening; and replacing said partition material reel with a second partition material reel having partition material by pushing said second partition material reel through said opening into said partition material cavity such that said partition material is accessible through said upright member.

2. The method of claim 1, wherein said opening is a base opening on the bottom of said base.

3. The method of claim 1, wherein said opening is a side opening along the side of said material housing unit.

4. The method of claim 3, wherein said side opening is covered by a series of flaps.

5. The method of claim 2, wherein said base opening is covered by a series of flaps.

6. The method of claim 1, wherein said material housing cavity further includes a spindle.

7. The method of claim 1, wherein said material housing cavity further includes a direct feed port.

8. The method of claim 1, wherein said upright member of said delineating device is conical shaped.

9. The method of claim 8, wherein said conical shaped upright member is collapsible.

10. The method of claim 1, further comprising providing a light located inside of said upright member such that said upright member illuminates.

11. A method of using a delineating device to dispense an amount of partition material on a partition material reel, comprising the steps of:

providing said delineating device comprising an upright member, having a cavity and an exit opening; a base removably attached to said upright member, having is material housing unit, a material housing cavity and an opening, wherein said upright member is detachable from said base;

inserting said partition material reel into said material housing cavity through said opening such that said partition material is capable of extending upward from said base through said cavity of said upright member and out of said exit opening;

depleting said partition material;

removing said partition material red once said partition material is depleted by pulling said partition material reel through said opening; and replacing said partition material reel with a second partition material reel having partition material by pushing said second partition material reel through said opening into said partition material cavity such that said partition material is accessible through said upright member.

12. The method of claim 1, wherein, said opening is a base opening on the bottom of said base.

13. The method of claim 11, wherein said opening is a side opening along the side of said material housing unit.

14. The method of claim 12, wherein said side opening is covered by a series of flaps.

15. The method of claim 13, wherein said base opening is covered by a series of flaps.

16. The method of claim 11, wherein said material housing cavity further includes a spindle.

17. The method of claim 1 wherein said material housing cavity further includes a direct feed port.

18. A method of using a delineating device to dispense an amount of partition material on a partition material reel, comprising the steps of:

providing said delineating device comprising an upright member, having a cavity and a series of exposed channels; a base attached to said upright member, having at least one material housing unit, at least one material housing cavity and at least one opening;

inserting said partition material reel into said at least one material housing cavity through said at least one opening such that said partition material is capable of extending upward from said base through said series of exposed channels of said upright member;

depleting said, partition material;

removing said partition material reel once said partition material is depleted by pulling said partition material reel through said opening; and replacing said partition material reel with a second partition material reel having partition material by pushing said second partition material reel through said opening into said partition material cavity such that said partition material is accessible through said upright member.

19. The method of claim 18, wherein said at least one material housing cavity further includes a spindle.

20. The method of claim 18, wherein said upright member of said delineating device is a barrel.

* * * * *